US008843005B2

(12) United States Patent
Yoshida et al.

(10) Patent No.: US 8,843,005 B2
(45) Date of Patent: Sep. 23, 2014

(54) DEVELOPING DEVICE, PROCESS UNIT, AND IMAGE FORMING APPARATUS

(71) Applicants: Tomofumi Yoshida, Osaka (JP); Shinichi Arasawa, Osaka (JP)

(72) Inventors: Tomofumi Yoshida, Osaka (JP); Shinichi Arasawa, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 76 days.

(21) Appl. No.: 13/682,984

(22) Filed: Nov. 21, 2012

(65) Prior Publication Data

US 2013/0136465 A1 May 30, 2013

(30) Foreign Application Priority Data

Nov. 30, 2011 (JP) ..... 2011-262971
Jan. 12, 2012 (JP) ..... 2012-004200

(51) Int. Cl.
*G03G 15/08* (2006.01)

(52) U.S. Cl.
CPC ..... *G03G 15/0824* (2013.01); *G03G 15/0891* (2013.01); *G03G 15/0858* (2013.01)
USPC ..... 399/27; 399/28

(58) Field of Classification Search
CPC ..... G03G 15/0824; G03G 15/0858; G03G 15/0891
See application file for complete search history.

(56) References Cited

U.S. PATENT DOCUMENTS

| | | | | |
|---|---|---|---|---|
| 4,739,365 | A * | 4/1988 | Hino | 399/63 |
| 5,576,814 | A * | 11/1996 | Nishimura et al. | 399/276 |
| 2008/0145119 | A1 | 6/2008 | Tatsumi et al. | |
| 2008/0187358 | A1 | 8/2008 | Kubota et al. | |
| 2008/0205930 | A1 | 8/2008 | Kawakami et al. | |
| 2008/0267661 | A1 | 10/2008 | Yoshida et al. | |
| 2009/0022531 | A1 | 1/2009 | Kubota et al. | |
| 2012/0033982 | A1 | 2/2012 | Kubota et al. | |

FOREIGN PATENT DOCUMENTS

| | | | | |
|---|---|---|---|---|
| JP | H02-085452 U | | 7/1990 | |
| JP | H09-146358 | | 6/1997 | |
| JP | 2002-278248 | | 9/2002 | |
| JP | 2010-066769 | * | 3/2010 | G03G 15/08 |

* cited by examiner

*Primary Examiner* — Clayton E Laballe
*Assistant Examiner* — Jas Sanghera
(74) *Attorney, Agent, or Firm* — IPUSA, PLLC

(57) ABSTRACT

A developing device includes a developing chamber; a toner carrier disposed in the developing chamber; a toner supply part configured to supply toner to the toner carrier; a toner amount detecting part configured to change its rotational position according to the amount of toner near the toner supply part to detect the amount of toner remaining in the developing chamber; and a toner flow restricting part configured to block movement of the toner around the toner amount detecting part which is caused by a flow of the toner in the developing chamber generated by the rotation of the toner supply part and the toner carrier.

19 Claims, 16 Drawing Sheets

DEVELOPING DEVICE, PROCESS UNIT, AND IMAGE FORMING APPARATUS

CROSS-REFERENCE TO RELATED APPLICATIONS

The present application is based upon and claims the benefit of priority of Japanese Patent Application No. 2011-262971, filed on Nov. 30, 2011 and Japanese Patent Application No. 2012-004200, filed on Jan. 12, 2012, the entire contents of which are incorporated herein by reference.

BACKGROUND OF THE INVENTION

1. Field of the Invention

An aspect of this disclosure relates to a developing device, a process unit, and an image forming apparatus.

2. Description of the Related Art

Japanese Laid-Open Patent Publication No. 2010-66769, for example, discloses an electrophotographic image forming apparatus including a toner amount detecting mechanism that detects the amount of remaining toner in a developing device or a process unit and reports to the user the timing to refill or replace the developing device or the process unit (this timing may be hereafter referred to as "toner replacement timing").

The disclosed toner amount detecting mechanism includes a toner amount detecting part that changes its rotational positions according to the amount of remaining toner in a toner container of the developing device and an arm that is coupled with the toner amount detecting part and visible from the outside of the developing device or the process unit. When the amount of remaining toner in the toner container becomes less than or equal to a predetermined amount, the rotational range of the toner amount detecting part is extended toward a toner carrier of the developing device and the position of the arm is detected by a sensor provided at the image forming apparatus to detect a decrease in the amount of remaining toner (i.e., detect the toner replacement timing).

With the configuration disclosed in JP2010-66769, when toner is consumed in printing and the surface level of toner becomes lower than or equal to the height of the rotational shaft of the toner amount detecting part, or when the initial amount of toner is low and the surface level of toner is lower than or equal to the height of the rotational shaft of the toner amount detecting part, a space is formed between the toner amount detecting part and a limiting part (developing blade). In such a case, toner below the toner amount detecting part may be carried away due to a toner flow caused by the rotation of a toner supply part and a toner carrier. As a result, the rotational range of the toner amount detecting part is extended toward the toner carrier, the arm is detected by the sensor of the image forming apparatus, and the toner replacement timing is reported to the user even when a sufficient amount of toner for development still exists in the toner container.

SUMMARY OF THE INVENTION

In an aspect of this disclosure, there is provided a developing device that includes a developing chamber; a toner carrier disposed in the developing chamber; a toner supply part configured to supply toner to the toner carrier; a toner amount detecting part configured to change its rotational position according to the amount of toner near the toner supply part to detect the amount of toner remaining in the developing chamber; and a toner flow restricting part configured to block movement of the toner around the toner amount detecting part which is caused by a flow of the toner in the developing chamber generated by the rotation of the toner supply part and the toner carrier.

DESCRIPTION OF THE PREFERRED EMBODIMENTS

Preferred embodiments of the present invention are described below with reference to the accompanying drawings.

<Configuration of Image Forming Apparatus>

Figure 1:
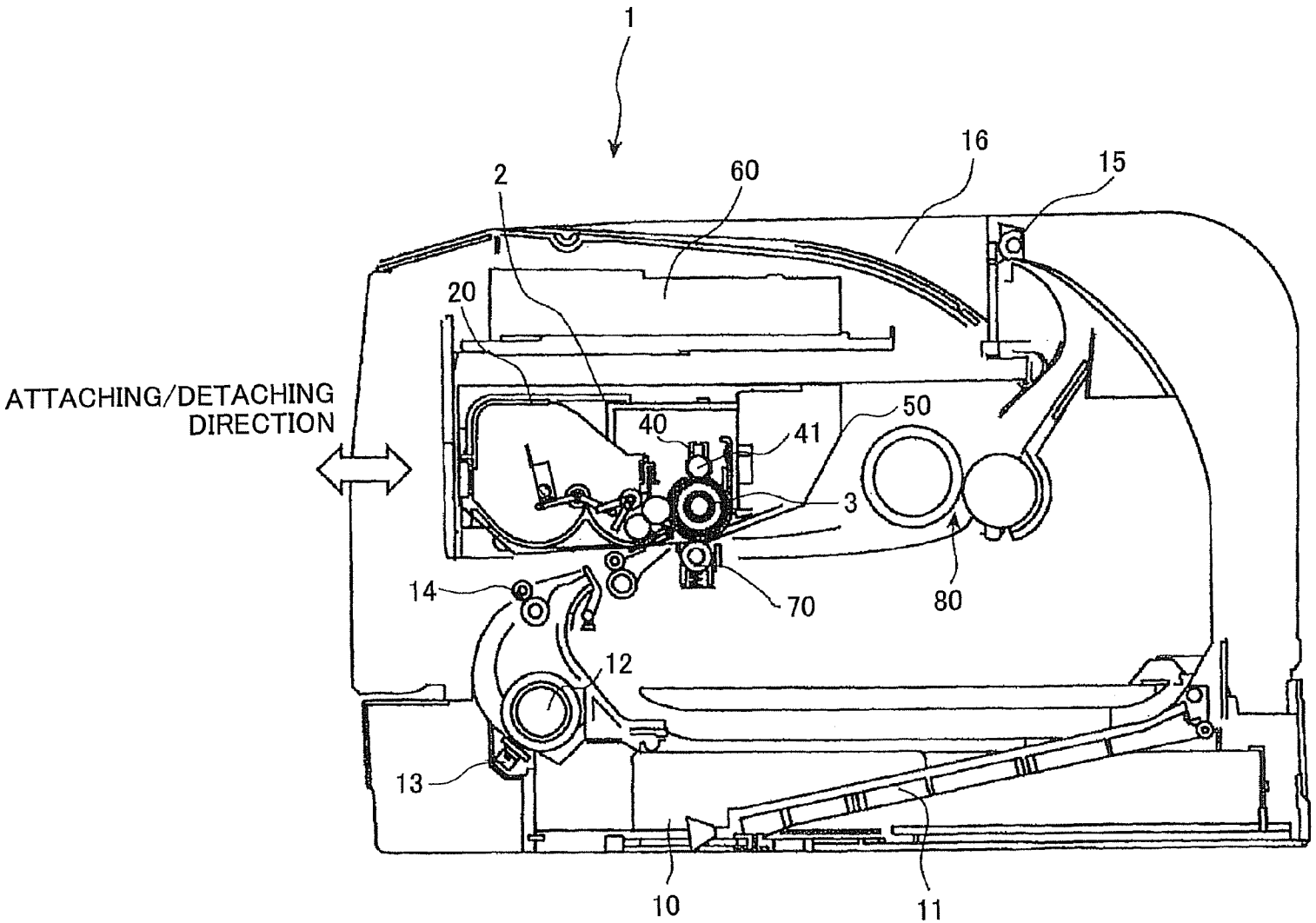
FIG. 1 is a drawing illustrating an exemplary configuration of an image forming apparatus including a developing unit according to an embodiment.

FIG. 1 is a drawing illustrating an exemplary configuration of an image forming apparatus 1 according to an embodiment. As illustrated in FIG. 1, the image forming apparatus 1 includes a process unit 2 and a paper-feed unit 10 disposed below the process unit 2. The paper-feed unit 10 includes a paper-feed cassette 11.

An exposing unit 60 is disposed above the process unit 2. The exposing unit 60 illuminates a photoconductor (image carrier) 3 with a laser beam to form a latent image on the photoconductor 3.

The process unit 2 includes the photoconductor 3, a charging unit 40 that charges the surface of the photoconductor 3, a developing unit (developing device) 20 that visualizes an electrostatic latent image formed on the photoconductor 3 with toner to form a toner image, and a cleaning unit 50 that removes and collects toner remaining on the photoconductor 3.

The image forming apparatus 1 further includes a transfer unit 70 that transfers a toner image from the photoconductor 3 onto a recording medium (e.g., paper) and a fusing unit 80 that fuses the toner image onto the recording medium by causing the recording medium to pass through a pair of rollers that apply heat and pressure to the toner image.

With the above configuration, the image forming apparatus 1 functions as a printer that records an image on a recording medium based on digital image information. The image forming apparatus 1 may also include a control unit, a communication unit, a scanning unit for scanning a document, and a document feeder, and may be implemented as a multifunction peripheral that includes a facsimile function for transmitting and receiving image information to and from a remote apparatus and a function of a copier.

Configurations of components of the image forming apparatus 1 and processes performed by the image forming apparatus 1 are described below.

<Configuration of Photoconductor>

The material, shape, structure, and size of the photoconductor 3 may be selected freely according to its purpose. For example, the photoconductor 3 may be shaped like a drum, a sheet, or an endless belt. The size of the photoconductor 3 may be determined freely according to the size and specifications of the image forming apparatus 1.

Exemplary materials of the photoconductor 3 include inorganic photoconductors such as amorphous silicon, selenium, cadmium sulfide (CdS), and zinc oxide (ZnO), and organic photoconductors such as polysilane and phthalopolymethine.

An organic photoconductor may have a single layer structure or a laminated structure. A photoconductor with a single-layer structure may include a base and a single-layer photosensitive layer formed on the base, and may also include a protective layer, an intermediate layer, and other layers as necessary. A photoconductor with a laminated structure may include a base and a laminated photosensitive layer formed on the base, and may also include a protective layer, an intermediate layer, and other layers as necessary. The laminated photosensitive layer includes at least a charge generation layer and a charge transport layer arranged in this order.

<Charging Process>

In a charging process, the charging unit 40 uniformly charges the surface of the photoconductor 3 by applying a voltage to the surface. The charging unit 40 may be implemented either as a contact charging unit that contacts and charges the photoconductor 3 or a non-contact charging unit that charges the photoconductor 3 without contacting the photoconductor 3.

A contact charging unit may include, for example, a conductive or semiconductive charging roller, a magnetic brush, a fur brush, a film, or a rubber blade. Among them, a charging roller is particularly preferable. A charging roller can greatly reduce the amount of ozone generation compared with a corona discharge method, stably charge the photoconductor 3 even when the photoconductor 3 is repeatedly used, and prevent degradation of image quality.

In the present embodiment, the charging unit 40 includes a charging roller 41. Although not illustrated, the charging roller 41 may include a cylindrical metal shaft used as a conductive support, a resistance adjusting layer formed on the outer surface of the metal shaft, and a protective layer that covers the surface of the resistance adjusting layer to prevent leakage.

The charging roller 41 is connected to a power supply that applies a predetermined voltage to the charging roller 41. Although only a direct-current (DC) voltage may be applied to the charging roller 41, it is preferable to apply a voltage obtained by superposing an alternating (AC) voltage on a DC voltage to the charging roller 41. Applying an AC voltage to the charging roller 41 makes it possible to more uniformly charge the surface of the photoconductor 3.

Meanwhile, a non-contact charging unit may include a non-contact charging wire employing a corona discharge method, a needle electrode device, or a conductive or semiconductive charging roller that is disposed at a very small distance from the photoconductor 3.

The corona discharge method is a non-contact charging method where positive or negative ions generated by corona discharge in the atmosphere are supplied to the surface of the photoconductor 3. The corona discharge method may be implemented by a corotron charger that provides a constant amount of electric charge to the photoconductor 3 or a scorotron charger that provides a constant potential to the photoconductor 3. A corotron charger may include a discharge wire and a casing electrode that occupies a half space around the discharge wire.

A scorotron charger is made by adding a grid electrode to a corotron charger. The grid electrode is disposed at a very small distance (e.g., from 1.0 mm to 2.0 mm) from the surface of the photoconductor 3. When the charging roller 41 is used for a non-contact charging unit, the charging roller 41 is disposed such that a very small gap is formed between the charging roller 41 and the photoconductor 3. The distance of the gap is preferably from about 10 μm to about 200 μm, and more preferably from about 10 μm to about 100 μm.

<Exposing Process>

In an exposing process, the exposing unit 60 exposes the charged surface of the photoconductor 3. More specifically, the exposing unit 60 illuminates the charged surface of the photoconductor 3 to form an electrostatic latent image. The exposing unit 60 may include an analog optical system and/or a digital optical system.

The analog optical system projects light reflected from a document onto the photoconductor 3. The digital optical system receives image information as an electric signal and converts the electric signal into an optical signal to illuminate and form an image on the photoconductor 3.

The exposing unit 60 may include an illuminating unit for exposing or illuminating the charged surface of the photoconductor 3 to form an image according to image information. The illuminating unit may be implemented by, for example, a rod lens array, a liquid crystal shutter optical system, an LED optical system, or a laser diode (LD) optical system depending on the purpose. Among them, the LD optical system is particularly preferable.

<Developing Process>

In a developing process, the developing unit 20 develops an electronic latent image formed on the photoconductor 3 using toner (developer) to form a visual image (toner image). In the present embodiment, the developing unit 20 uses a single-component developer to develop an electronic latent image. Either magnetic toner or non-magnetic toner may be used as the single-component developer. The configuration of the developing unit 20 is described later.

<Transfer Process>

In a transfer process, the transfer unit 70 transfers a visible image (toner image) from the photoconductor 3 to a recording medium. The transfer unit 70 may be configured either as a direct transfer unit or a secondary transfer unit. The direct transfer unit transfers a visible image directly from the photoconductor 3 to a recording medium. The secondary transfer unit transfers a visible image from an intermediate transfer unit, to which the visible image is transferred from the photoconductor 3, to a recording medium. To reduce the size of the image forming apparatus 1, the direct transfer unit is preferable. The transfer unit 70 may be implemented, for example, by a corona transfer unit employing corona discharge, a transfer belt, a transfer roller, a pressure transfer roller, or an adhesive transfer unit. In the present embodiment, it is assumed that a roller is used as the transfer unit 70.

Recording media stored in the paper-feed cassette 11 are not limited to sheets of paper. Any type of recording media may be used as long as developed images (toner images) can be transferred onto the recording media. For example, OHP sheets made of polyethylene terephthalate (PET) may be used as recording media.

<Fusing Process>

In a fusing process, the fusing unit 80 fuses (or fixes) a transferred visible image onto a recording medium. The fusing unit 80 may include fusing parts and a heat source for heating the fusing parts. The fusing parts may be implemented by a combination of various parts such as a combination of an endless belt and a roller or a combination of rollers as long as the parts can form a nip between them.

When the fusing parts include a roller, the metal shaft of the roller is preferably made of an inelastic material so that the roller is not deformed by a high pressure. The inelastic material may be freely selected depending on the purpose. For example, a highly thermal conductive material such as aluminum, iron, stainless steel, or brass is preferably used.

Also, the surface of the roller is preferably coated with an offset preventing layer. Exemplary materials for the offset preventing layer include room temperature vulcanizing (RTV) silicone rubber, tetrafluoroethylene-perfluoroalkylvinyl ether (PFA), and polytetrafluoroethylene (PTFE).

In the fusing process, a recording medium, onto which a toner image has been transferred, is caused to pass through the nip between the fusing parts of the fusing unit 80 to fuse the toner image. Alternatively, the fusing unit 80 may be configured to simultaneously transfer a toner image onto a recording medium and fuse the toner image by causing the recording medium to pass through the nip.

<Cleaning Process>

In a cleaning process, the cleaning unit 50 removes toner remaining on the photoconductor 3 after the fusing process. Alternatively, a developing roller (toner carrier) 21 of the developing unit 20 may be configured to develop an electrostatic latent image formed on the photoconductor 3 as well as to collect remaining toner from the photoconductor 3. In this case, the cleaning unit 50 may be omitted. Any type of cleaning part may be used for the cleaning unit 50 as long as it can remove toner remaining on the photoconductor 3. For example, the cleaning unit 50 may include a magnetic brush cleaner, an electrostatic brush cleaner, a magnetic roller cleaner, a cleaning blade, a brush cleaner, or a web cleaner. Among them, a cleaning blade is particularly preferable, since it is small and inexpensive but can still effectively remove toner. In the present embodiment, the cleaning unit 50 includes a cleaning blade 51. Exemplary materials for the cleaning blade 51 include polyurethane rubber, silicone rubber, fluororubber, chloroprene rubber, and butadiene rubber. Among them, polyurethane rubber is particularly preferable.

<Image Forming Process Performed by Image Forming Apparatus>

An exemplary image forming process performed by the image forming apparatus 1 is described below.

As illustrated in FIG. 1, the charging roller 41 of the charging unit 40 uniformly charges the surface of the photoconductor 3 being rotated. Next, the exposing unit 60 scans the charged surface of the photoconductor 3 with a laser beam to form an electrostatic latent image according to image information received from another component of the image forming apparatus 1 or another apparatus.

The photoconductor 3 is disposed in the process unit 2 together with the charging unit 40, the developing unit 20, and the cleaning unit 50. The developing unit 20 of the process unit 2 develops the electrostatic latent image on the photoconductor 3 to form a visible image (toner image).

The transfer unit 70 is disposed downstream of the developing unit 20 in the rotational direction of the photoconductor 3. A recording medium is fed from the paper-feed cassette 11 into a position between registration rollers 14, and further fed into a transfer area (or a position between the photoconductor 3 and the transfer unit 70) at the timing when the visible image on the photoconductor 3 enters the transfer area. As the recording medium passes through the transfer area, the visible image is transferred by the transfer unit 70 from the photoconductor 3 onto the recording medium.

Toner (hereafter referred to as "post-transfer residual toner") still remaining on the surface of the photoconductor 3 after passing through the transfer area is removed by the cleaning unit 50. In the present embodiment, the post-transfer residual toner is removed by the cleaning blade 51 of the cleaning unit 50.

After the visible image is transferred, the recording medium is conveyed to a fusing area of the fusing unit 80. The fusing area is formed between, for example, a fusing roller and a pressure roller of the fusing unit 80. The visible image is fused onto the recording medium by heat and pressure applied by the fusing roller and the pressure roller. The recording medium is fed further by the fusing and pressure rollers to paper-ejecting rollers 15 and ejected by the paper-ejecting rollers 15 onto a paper-catch tray 16 of the image forming apparatus 1.

<Configuration of Process Unit>

Figure 2:
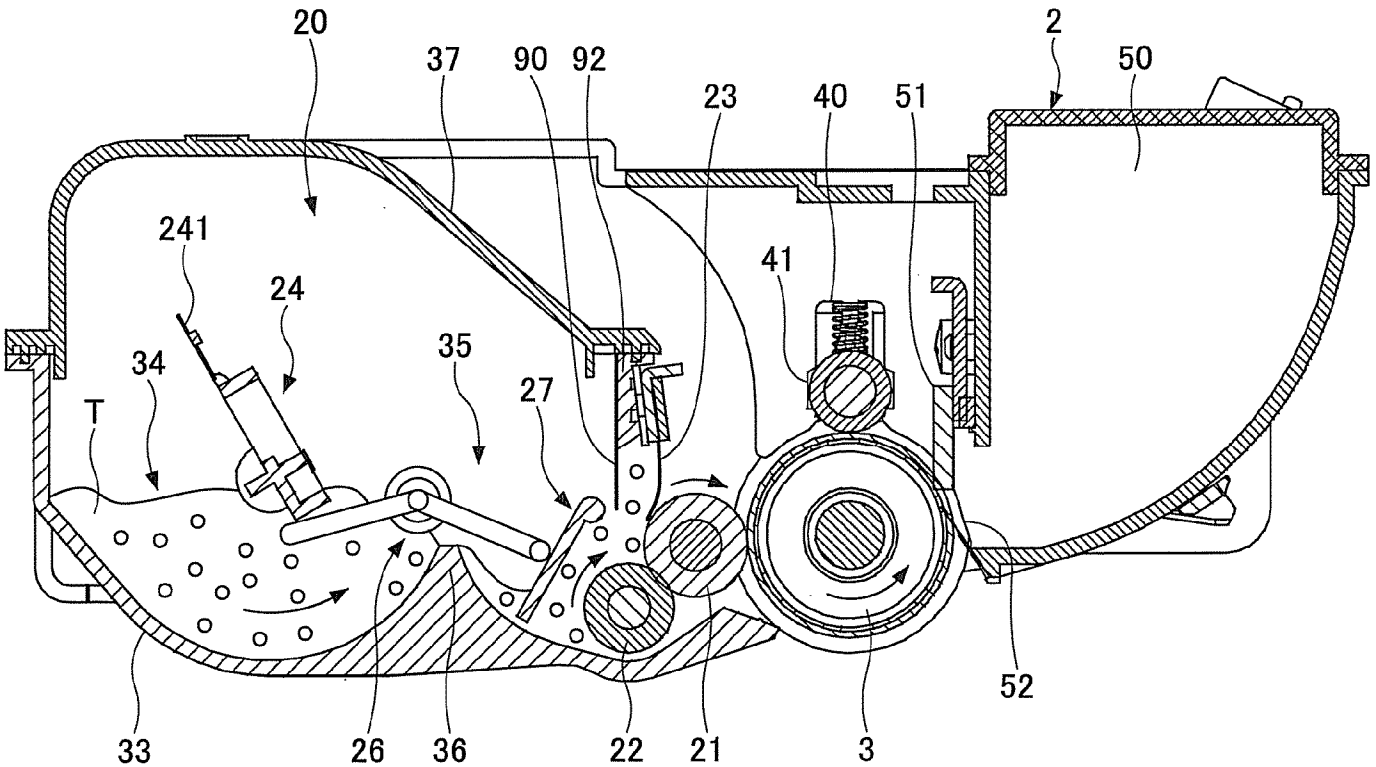
FIG. 2 is a cut-away side view of a process unit including a developing unit according to an embodiment.

FIG. 2 is a cut-away side view of the process unit 2. As illustrated in FIG. 2, the process unit 2 includes the photoconductor 3 and one or more other units. In the present embodiment, the process unit 2 includes, the charging unit 40 including the charging roller 41 for charging the photoconductor 3, the developing unit 20 for developing a latent image formed on the photoconductor 3, and the cleaning unit 50 including the cleaning blade 51 for removing toner T remaining on the surface of the photoconductor 3.

The process unit 2 is attachable to and detachable from the image forming apparatus 1. In the example of FIG. 1, the process unit 2 is inserted into the image forming apparatus 1 along a guide part such as a rail (not shown) from one side of the image forming apparatus 1. This configuration makes it possible to quickly and easily replace the photoconductor 3 and other components of the process unit 2, and thereby makes it possible to reduce time and cost for maintenance. Also, since the photoconductor 3 and other units are integrated as the process unit 2, it is possible to accurately set the relative positions of the components of the photoconductor 3.

The developing unit 20 includes a lower housing and an upper housing (cover) 37. An internal space formed by the lower housing 33 and the upper housing 37 is separated into a container chamber 34 for containing single-component developer (toner) and a developing chamber 35 for supplying the single-component developer to the photoconductor 3. In the developing chamber 35, a developing roller (developer/toner carrier) 21 and a toner supply roller 22 are provided. The developing roller 21 carries the single-component developer and supplies the single-component developer to the photoconductor 3 to develop a latent image of the photoconductor 3. The toner supply roller 22 supplies the single-component developer to the developing roller 21.

A partition 36 protruding inward is formed between the container chamber 34 and the developing chamber 35. The partition 36 is a mountain-shaped wall that separates the internal space of the developing unit 20 into the container chamber 34 and the developing chamber 35.

In the developing unit 20, a toner layer is formed on the developing roller 21 and caused to contact the photoconductor 3 by the rotation of the developing roller 21 to develop an electrostatic latent image on the photoconductor 3. This is called a single-component contact developing method.

An agitating/conveying part 24 is disposed rotatably in the container chamber 34. The toner T in the developing unit 20 is agitated and conveyed over the partition 36 to the developing chamber 35 by the rotation of the agitating/conveying part 24, and is then supplied to the toner supply roller 22 disposed at the bottom of the developing chamber 35.

The toner supply roller 22 may be made of a flexible material such as polyurethane foam having cells with diameters from about 50 μm to about 500 μm for holding the toner T. The toner supply roller 22 preferably has a relatively low JIS-A hardness from about 10 to about 30 degrees so that the toner supply roller 22 can be brought into uniform contact with the developing roller 21.

The toner supply roller 22 is rotated in the same direction as the rotational direction of the developing roller 21. This means that the surfaces of the toner supply roller 22 and the developing roller 21 move in opposite directions in an area where they contact each other. The linear velocity ratio between the rollers 22 and 21 (linear velocity of toner supply roller 22/linear velocity of developing roller 21) is preferably from about 0.5 to about 1.5.

In an alternative configuration, the toner supply roller 22 may be rotated in a direction opposite to the rotational direction of the developing roller 21. In this case, the surfaces of the toner supply roller 22 and the developing roller 21 move in the same direction in an area where they contact each other. In the present embodiment, it is assumed that the toner supply roller 22 is rotated in the same direction as the rotational direction of the developing roller 21 and the linear velocity ratio is set at 0.9.

The toner supply roller 22 is configured to dig into (or dent) the surface of the developing roller 21, for example, by about 0.5 mm to about 1.5 mm. Assuming that the effective width of the process unit 2 is 240 mm (A4 portrait size), the torque for rotating the toner supply roller 22 is, for example, from about 14.7 N-cm to about 24.5 N-cm.

The developing roller 21 includes a base and a surface layer that is formed on the base and made of a rubber material. The diameter of the developing roller 21 is, for example, from about 10 mm to about 30 mm. A surface roughness Rz of the developing roller 21 is, for example, from about 1 μm to about 4 μm. The value of the surface roughness Rz is preferably about 13 percent to about 80 percent of the average particle diameter of the toner T. This makes it possible to prevent the toner T from being buried in the surface of the developing roller 21 and to efficiently convey the toner T.

The value of the surface roughness Rz of the developing roller 21 is more preferably about 20 percent to about 30 percent of the average particle diameter of the toner T so that toner T with a very low charge is not held by the developing roller 21. Exemplary rubber materials for the surface layer of the developing roller include silicone rubber, butadiene rubber, nitrile-butadiene rubber (NBR), hydrin rubber, and ethylene-propylene terpolymer rubber (EPDM).

It is also preferable to form a coating layer for covering the surface of the developing roller 21 to maintain the quality of the developing roller 21 over time. Exemplary materials of the coating layer include silicone materials and Teflon (registered trademark) materials.

Silicone materials have excellent toner charging capability and Teflon (registered trademark) materials have excellent release characteristics. To provide conductive properties, a conductive material such as carbon black may be added to the coating layer. The thickness of the coating layer is preferably from about 5 μm to about 50 μm. When the thickness is out of this range, the coating layer may become liable to crack.

The toner T has a predetermined polarity (in the present embodiment, negative polarity). The toner T on or in the toner supply roller 22 is sandwiched between the surfaces of the toner supply roller 22 and the developing roller 21 that move in opposite directions in a contact area. As a result, the toner T is negatively charged by frictional electrification, and is held on the developing roller 21 due to the electrostatic force and the surface roughness of the developing roller to form a toner layer.

At this stage, the thickness of the toner layer on the developing roller 21 is not uniform, and the amount of toner is excessive (e.g., 1-3 mg/cm$^2$). To form a thin toner layer with a uniform thickness on the developing roller 21, a limiting part 23 is provided. The limiting part 23 is in contact with the outer surface of the developing roller 21 and limits the thickness of the toner layer.

The limiting part 23 is made of a thin, flexible plate. The upper end of the limiting part 23 is attached to an edge of the upper housing 37 of the developing unit 20, and the lower end of the limiting part 23 extends downward in a substantially vertical direction (or in the direction of gravitational force) as a free end. The width of the limiting part 23 is substantially the same as the width of the developing roller 21 in the axial direction.

The lower end of the limiting part 23 faces a direction that is opposite to the rotational direction of the developing roller 21. A part of the limiting part 23 which is higher than the lower end is in contact with the surface of the developing roller 21. Alternatively, the limiting part 23 may be configured such that the lower end of the limiting part 23 faces the same direction as the rotational direction of the developing roller 21 and is in contact with the surface of the developing roller 21. The limiting part 23 is preferably made of metal such as stainless steel (e.g., SUS 304). In this case, the thickness of the limiting part 23 is preferably from about 0.05 mm to about 0.15 mm so that the limiting part 23 can be elastically deformed.

Alternatively, the limiting part 23 may be made of a rubber material such as polyurethane rubber or a resin with relatively high hardness such as a silicone resin. In this case, the thickness of the limiting part 23 is preferably from about 1 mm to about 2 mm. A bias supply may be connected to the limiting part 23 to form an electric field between the limiting part 23 and the developing roller 21. This is possible even when a material other than metal is used for the limiting part 23 by reducing the resistance of the material by mixing, for example, carbon black.

A toner amount detecting part 27 is provided in the developing chamber 35, and toner flow restricting parts 90 are provided between the developing roller 21 and the toner amount detecting part 27. The upper ends of the toner flow restricting parts 90 are held by a fixing part 92 that extends horizontally across the lower housing 33. The free ends (lower ends) of the toner flow restricting parts 90 extend downward in a substantially vertical direction (or in the direction of gravitational force), and are positioned on the right side of the rotational shaft of the toner amount detecting part 27. The configuration and effects of the toner flow restricting parts 90 are described in detail later.

Figure 3:
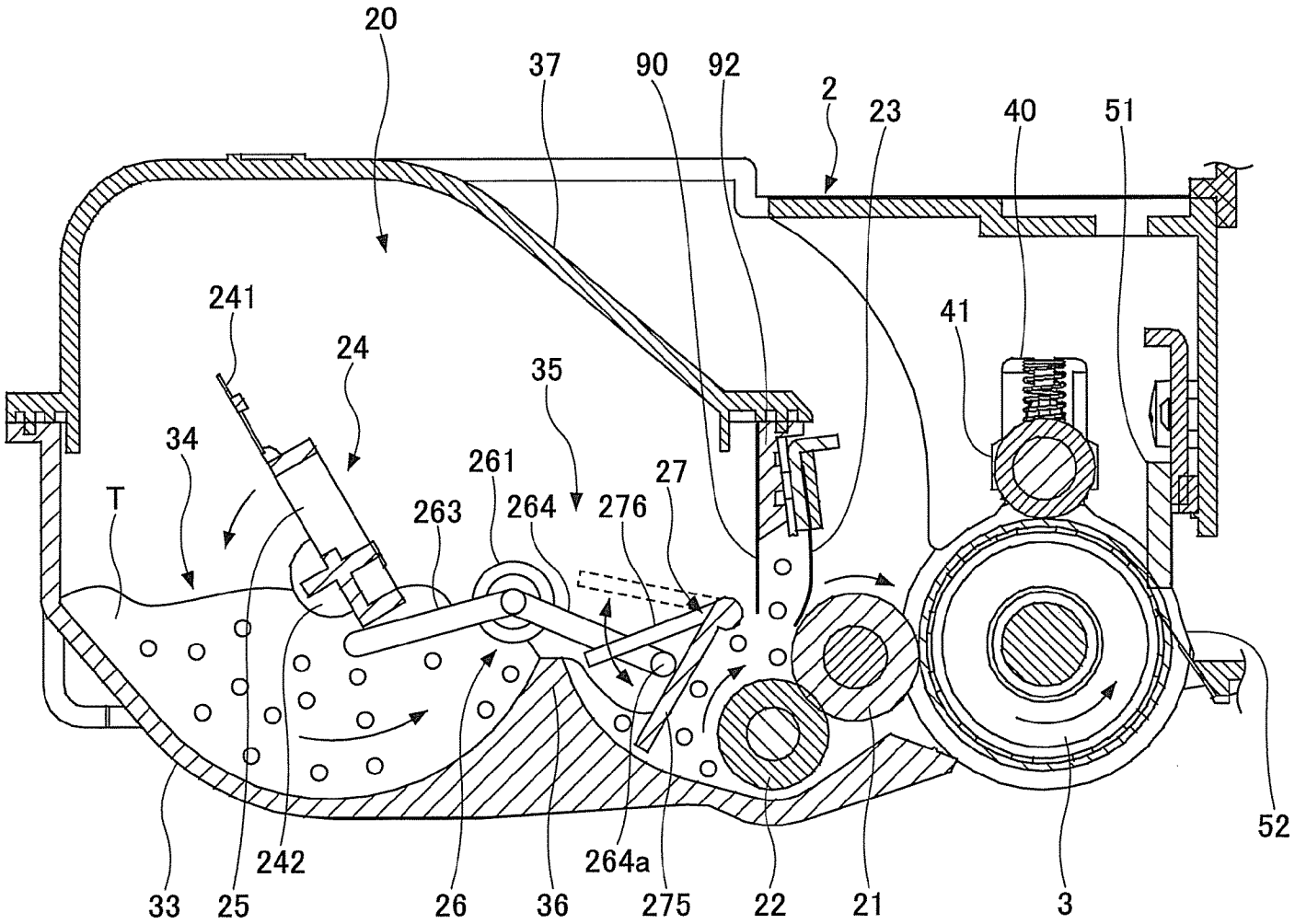
FIG. 3 is a cut-away side view of a developing unit according to an embodiment.

FIG. 3 is a cut-away side view of the developing unit 20 according to the present embodiment. As illustrated in FIG. 3, the developing unit 20 includes the agitating/conveying part 24, the toner amount detecting part 27, and a synchronizing part 26.

The agitating/conveying part 24 is disposed substantially in the center of the container chamber 34 of the developing unit 20. The agitating/conveying part rotates to agitate and thereby charge the toner T (single-component developer) in the container chamber 34, and conveys the toner T to the developing chamber 35 adjacent to the container chamber 34.

The toner amount detecting part 27 is disposed rotatably in the developing chamber 35 and constitutes a part of a toner amount detecting mechanism for detecting the amount of remaining toner in the developing chamber 35. The toner amount detecting part 27 changes its rotational positions according to the amount of remaining toner T in the developing chamber 35. "Toner replacement timing" (the timing to refill the developing unit 20 or to replace the process unit 2) is determined based on the rotational position of the toner amount detecting part 27.

The synchronizing unit 26 is disposed near the partition 36 and configured to pivot. The synchronizing unit 26 transmits the rotational force of the agitating/conveying part 24 to the toner amount detecting unit 27. In other words, the synchronizing unit 26 synchronizes the rotation of the agitating/conveying part 24 and the rotation of the toner amount detecting part 27.

<Configuration of Toner Flow Restricting Parts>

Figure 4:
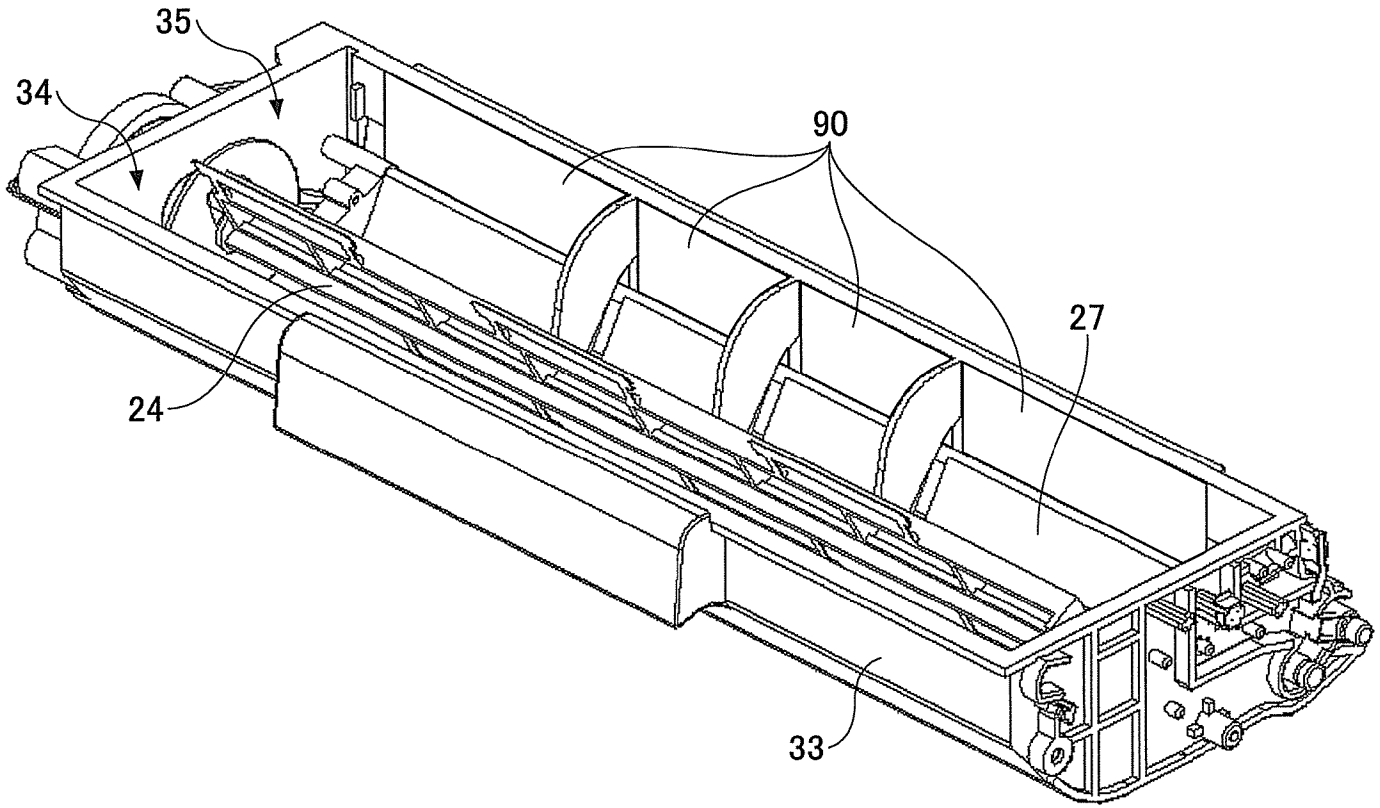
FIG. 4 is a drawing illustrating toner flow restricting parts according an embodiment.
Figure 5A:
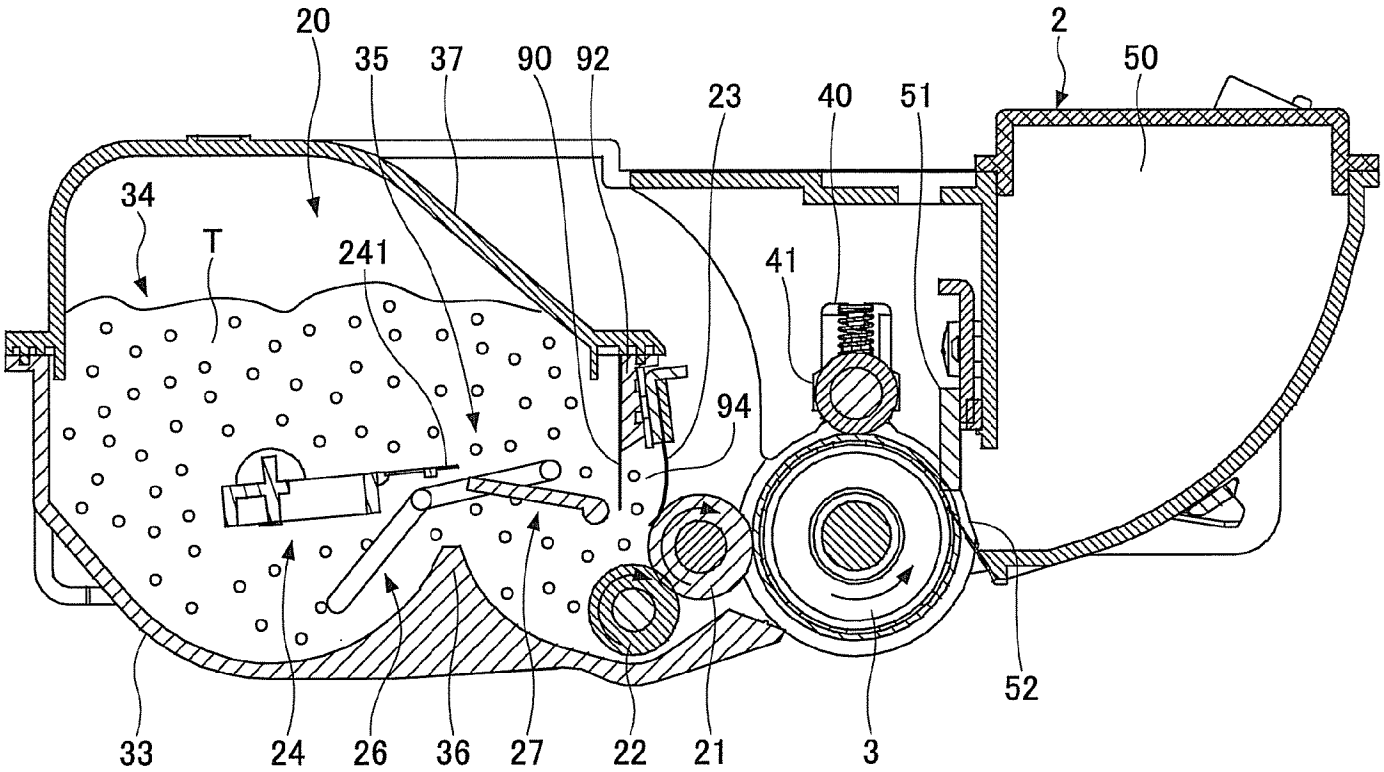
FIG. 5A is a drawing illustrating a rotational position of a toner amount detecting part when the amount of remaining toner is sufficient.
Figure 5B:
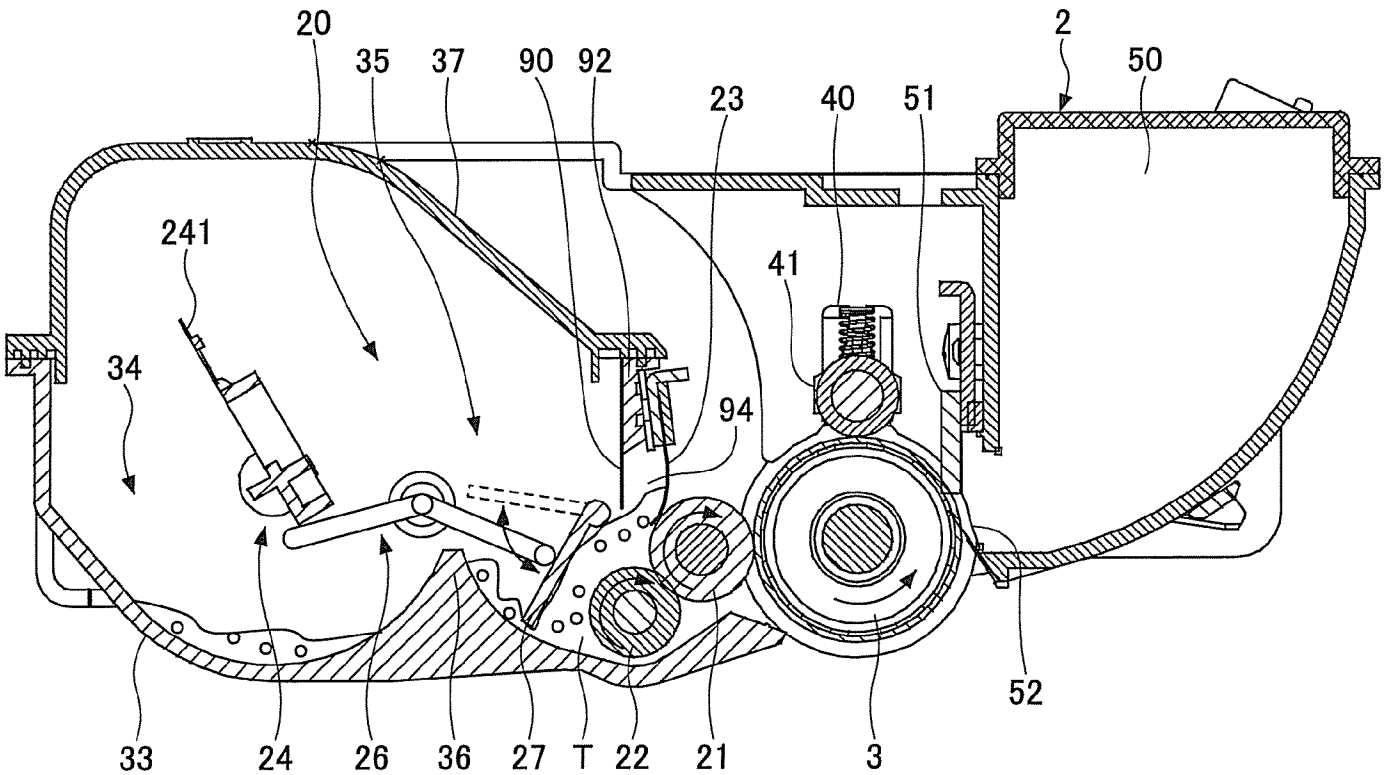
FIG. 5B is a drawing illustrating a rotational position of a toner amount detecting part when the amount of remaining toner is small.

FIG. 4 is a drawing illustrating the toner flow restricting parts 90 installed in the developing unit 20. In FIG. 4, the upper housing 37 is removed so that the toner flow restricting parts 90 are viewable. FIG. 5A is a drawing illustrating a rotational position of the toner amount detecting part 27 when there is a sufficient amount of toner. FIG. 5B is a drawing illustrating a rotational position of the toner amount detecting part 27 when the amount of remaining toner is small.

In the present embodiment, as illustrated in FIGS. 4 and 5A, four toner flow restricting parts 90 are provided to prevent or block the movement of toner around the toner amount detecting part 27 (i.e., flow of toner from an area below the toner amount detecting part 27 to an area above the toner amount detecting part 27) which is caused by a flow of toner in the developing chamber 35 generated by the rotation of the toner supply roller 22 and the developing roller 21. More specifically, the toner flow restricting parts 90 are disposed in a square-bracket-shaped area 94 formed between the limiting part 23 and the toner amount detecting part 27, and prevent or block toner flowing through a space between the upper housing 37 and the toner amount detecting part 27 to the upper side of the toner amount detecting part 27.

The toner flow restricting parts 90 are shaped like thin plates. The upper ends of the toner flow restricting parts 90 are supported by the fixing part 92 extending horizontally across the lower housing 33 that forms the developing chamber 35 together with the upper housing 37. The free ends (lower ends) of the toner flow restricting parts 90 extend downward in a substantially vertical direction (or in the direction of gravitational force).

The toner flow restricting parts 90 are arranged along the length direction of the toner supply roller 22 and the developing roller 21 substantially parallel to the rotational shaft of the toner amount detecting part 27. The free ends of some or all of the toner flow restricting parts 90 are positioned lower than the center of the rotational shaft of the toner amount detecting part 27 with respect to the direction of gravitational force. The toner flow restricting parts 90 may be fixed to the upper housing 37 by a double-sided tape or an adhesive. Alternatively, the toner flow restricting parts 90 may be fixed to the upper housing 37 by inserting bosses formed on the upper housing 37 into holes formed in the toner flow restricting parts 90 and fusing the bosses by heat.

As illustrated in FIG. 5B, as the amount of remaining toner T in the developing chamber 35 decreases, the toner amount detecting part 27 gradually rotates toward the toner supply roller 22 and the developing roller 21. Also in this case, the toner flow restricting parts 90 prevent or block the toner flow between the fixing part 92 of the lower housing 33 and the toner amount detecting part 27 (i.e., the toner flow from the under side to the upper side of the toner amount detecting part 27).

The toner flow restricting parts 90 may be made of a flexible sheet material. For example, the toner flow restricting parts 90 may be made of a resin material with relatively high hardness such as polyethylene terephthalate (PET) or polybutylene terephthalate (PBT). In this case, the thickness of the toner flow restricting parts 90 is preferably from about 1 mm to about 2 mm. Alternatively, the toner flow restricting parts 90 may be made of a metal material such as stainless steel (e.g., SUS 304) or phosphor bronze. In this case, the thickness of the toner flow restricting parts 90 is preferably from about 0.05 mm to about 0.15 mm so that the toner flow restricting parts 90 can be elastically deformed.

<Operations of Developing Unit>

Figure 6:
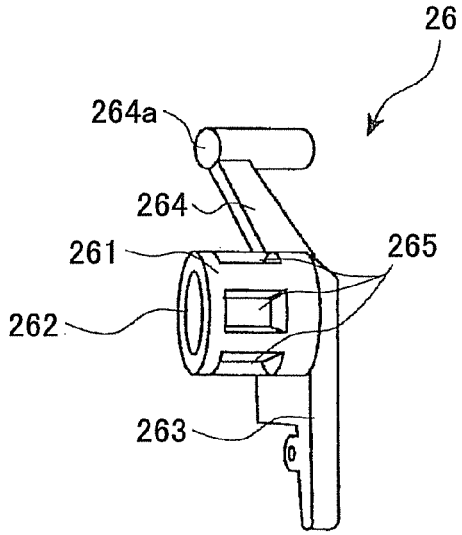
FIG. 6 is a drawing illustrating a synchronizing part for synchronizing a toner amount detecting part.
Figure 7:
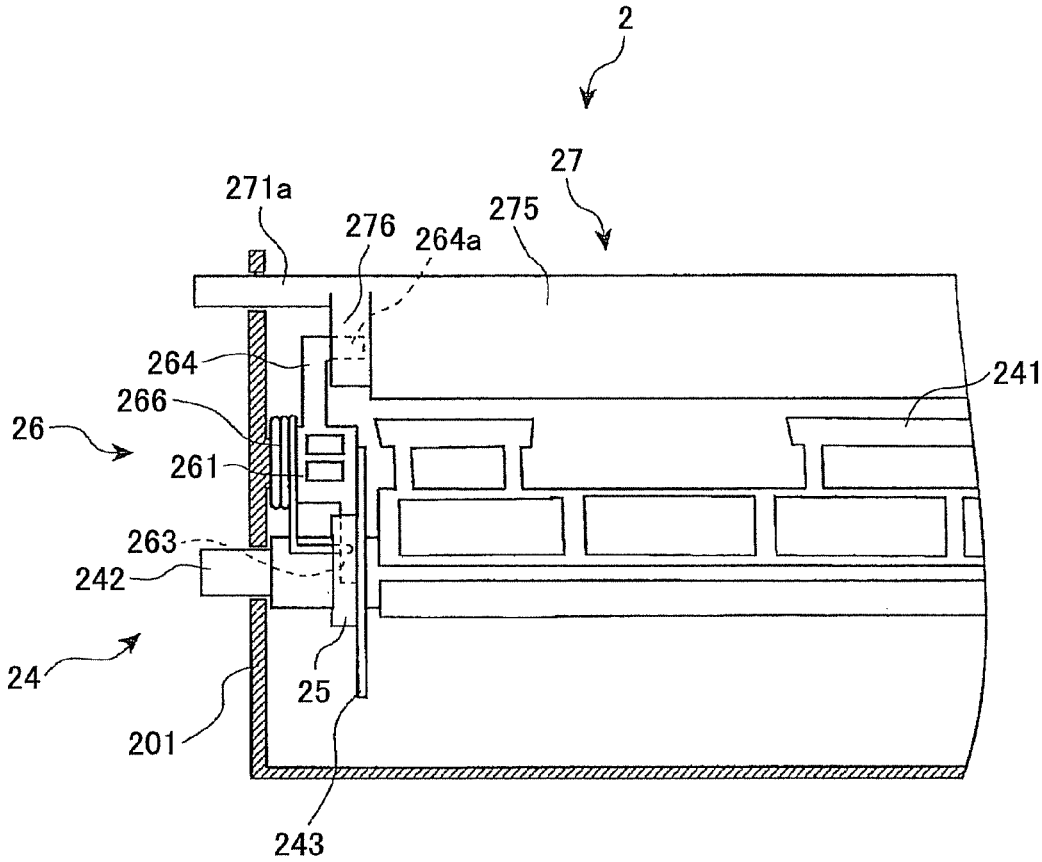
FIG. 7 is a drawing illustrating an agitating/conveying part, a synchronizing part, and a toner amount detecting part in a developing unit.

Operations of the agitating/conveying part 24, the toner amount detecting part 27, and the synchronizing part 26 are described below. FIG. 6 is a drawing illustrating the synchronizing part 26. FIG. 7 is a drawing illustrating the agitating/conveying part 24, the synchronizing part 26, and the toner amount detecting part 27 in the developing unit 20.

Referring to FIGS. 3 and 7, the agitating/conveying unit 24 includes a rotational shaft 242 and blades 241 attached to the rotational shaft 242. A cam 25 is attached to one end of the rotational shaft 242. The rotational shaft 242 is rotated in the direction of an arrow in FIG. 3 by a driving force provided by a drive motor (not shown). The cam 25 is slidably in contact with a first lever 263 of the synchronizing unit 26 and when rotated, causes the synchronizing part 26 to pivot.

The agitating/conveying part 24 agitates the toner T in the container chamber 34 and conveys the toner T from the container chamber 34 to the developing chamber 35.

Openings are formed by punching in the blades 241 of the agitating/conveying part 24. The positions of the openings and the sizes of the openings (i.e., the area of the blades 241) are adjusted to control the conveying and agitating capabilities of the agitating/conveying part 24. In other words, the openings of the blades 241 are adjusted so that an amount of toner consumed in each developing process is supplied to the developing chamber 35.

In the present embodiment, it is assumed that two blades 241 are provided. However, the agitating/conveying part 24 may include only one blade 241 or three or more blades 241. When plural blades 241 are provided, at least one of the blades 241 is preferably configured to mainly convey the toner T.

The blades 241 may be made of flexible resin films. The blades 241 made of flexible resin films can rub the bottom of the lower housing 33 of the developing unit 20 and efficiently convey the toner T in almost all areas of the container chamber 34 to the developing chamber 35. Exemplary resin materials for the blades 241 include olefin resins such as polypropylene and polyethylene, fluoroplastics such as polybutylene terephthalate and polyethylene terephthalate, and silicone resins. Instead of film materials, plate materials may also be used for the blades 241.

Referring to FIG. 7, a disk 243 is provided on the rotational shaft 242 of the agitating/conveying part 24. The disk 243 presses the synchronizing part 26 against a housing side wall 201 of the developing unit 20. Also, the position of the synchronizing unit 26 is determined by the thickness of the disk 243. Thus, the disk 243 prevents movement of the synchronizing part 26 in the axial direction and thereby improves the rotational accuracy of the synchronizing part 26. This in turn enables the synchronizing part 26 to be stably pivoted according to the rotation of the agitating/conveying part 24.

Referring to FIGS. 3 and 7, the toner amount detecting part 27 includes a rotational shaft 271*a*, a detecting plate 275, and an engaging part 276. The detecting plate 275 is a plate-shaped part that contacts the toner T and changes its rotational positions according to the amount of remaining toner T. The rotational shaft 271*a* is rotatably attached and a spring (not shown) is provided at one end of the rotational shaft 271*a*. The spring biases the detecting plate 275 downward or toward the toner supply roller 22.

Referring to FIGS. 3, 6, and 7, the synchronizing part 26 includes a cylindrical part 261, and the first lever 263 and a second lever 264 fixed to the cylindrical part 261. The first lever 23 is in contact with the cam 25 of the agitating/conveying part 24. The second lever 264 includes a leg 264*a* that engages the lower surface of the engaging part 276 of the toner amount detecting part 27.

The cylindrical part 261 has a shaft hole 262 whose one end is closed. A shaft protruding from the housing side wall 201 is inserted into the shaft hole 262. With this configuration, the synchronizing part 26 can pivot about the shaft. A torsion spring 266 is provided at an end of the cylindrical part 261. The torsion spring 266 biases the synchronizing part 26 such that the first lever 263 contacts the cam 25.

The synchronizing part 26 pivots according to the rotation of the cam 25, causes the toner amount detecting part 27 to rotate upward, and then let the toner amount detecting part 27 to fall (or rotate downward) by its own weight.

Referring to FIG. 6, openings 265 are formed in the cylindrical part 261 of the synchronizing part 26. Toner entering the shaft hole 262 can be ejected through the openings 265. Thus, the openings 265 make it possible to prevent toner from staying in the shaft hole 262 and thereby make it possible to prevent the shaft protruding from the housing side wall 201 and the cylindrical part 261 from being fixed to each other by fused toner.

Figure 8:
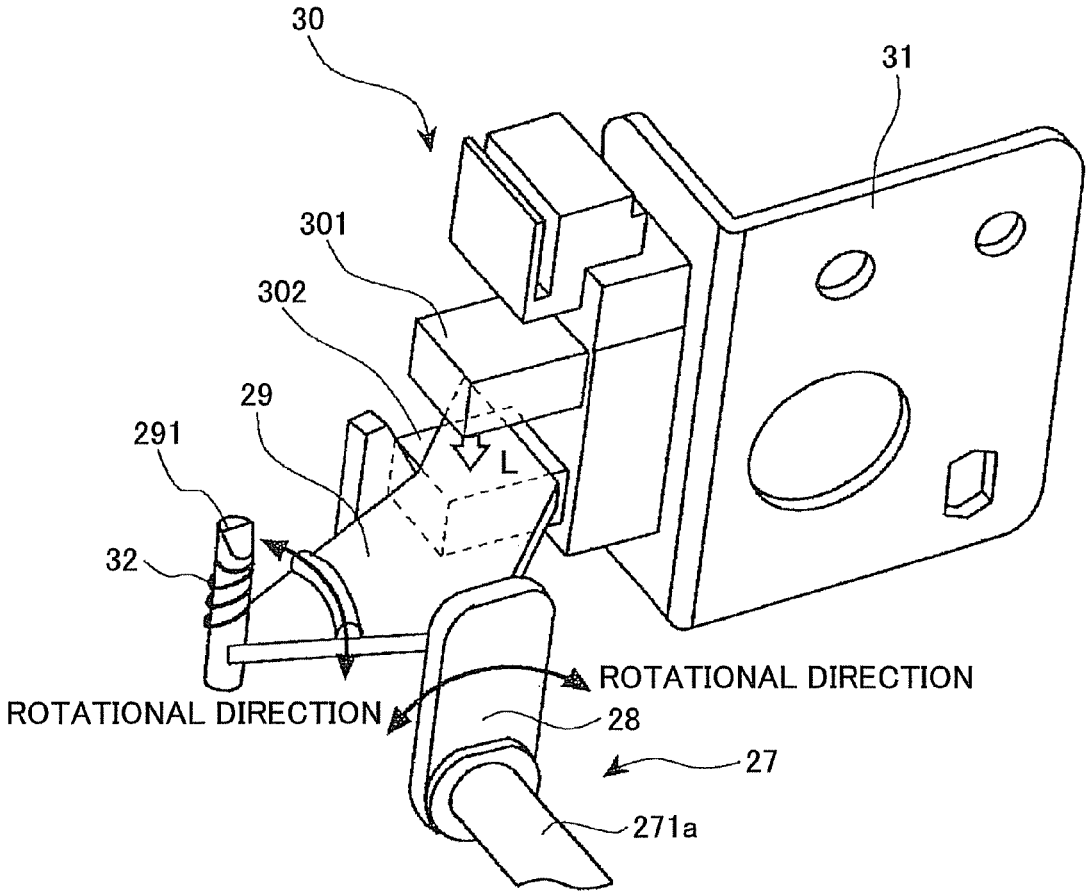
FIG. 8 is a perspective view of a reporting mechanism for reporting toner replacement timing.

FIG. 8 is a perspective view of a reporting mechanism for reporting toner replacement timing. As illustrated in FIG. 8, the reporting mechanism includes an arm 28 attached to and extending vertically upward (at approximately 90 degrees) from one end of the rotational shaft 271*a* of the toner amount detecting part 27, a rotating part 29 that is in contact with the arm 28 and rotates according to the rotation of the arm 28, and a sensor 30 that detects the rotational movement of the rotating part 29.

The rotating part 29 has a plate shape and is attached to a rotational shaft 291 that extends vertically upward from the body of the image forming apparatus 1. The rotating part 29 rotates horizontally about the rotational shaft 291 and is biased by a coil spring 32 toward the arm 28. One side (or an edge) of the rotating part 29, which is in contact with the arm 28, is shaped like a cam so that the rotational angle of the rotating part 29 changes according to the rotational position of the arm 28. With this configuration, rotation of the arm 28 on a vertical plane is converted into rotation of the rotating part 29 on a horizontal plane.

The sensor 30 is a light transmission sensor including a light-emitting element 301 and a light-receiving element 302 positioned below the light-emitting element 301. The sensor 30 is attached to a housing (not shown) of the image forming apparatus 31 via a bracket 31.

When the rotating part 29 rotates, a portion of the rotating part 29 passes between the light-emitting element 301 and the light-receiving element 302. The sensor 30 detects the portion of the rotating part 29 and thereby detects a rotational position of the toner amount detecting part 27 (this rotational position may be referred to as a "lower position" that indicates the toner replacement timing). The arm 28 is coaxial with the rotational shaft 271*a* of the toner amount detecting unit 27 and is exposed outside of the developing unit 20. The rotation of the arm 28 is transmitted to the rotating part 29 to detect the amount of remaining toner.

When there is a sufficient amount of toner T in the developing chamber 35, the rotational angle of the arm 28 is small. In this case, the rotational angle of the rotating part 29 is also small and the rotating part 29 is not detected by the sensor 30. Meanwhile, when the amount of toner is insufficient or there is no toner in the developing chamber 35, the toner amount detecting part 27 rotates to the lower position indicating the toner replacement timing. In this case, the rotating part 29 rotates widely and passes through the sensor 30. When the rotating part 29 passes through the sensor 30, the light emitted from the light-emitting element 301 toward the light-receiving element 302 is blocked by the rotating part 29 and as a result, the rotating part 29 is detected by the sensor 30. This configuration makes it possible to detect a decrease in the amount of remaining toner in the developing chamber 35 and to report the toner replacement timing to the user.

As an alternative configuration, the rotational angle or position of the arm 28 may be directly detected by an optical sensor. In this case, the rotating part 29 may be omitted.

When there is a sufficient amount of toner T in the container chamber 34 (e.g., when the process unit 2 is new), a large amount of toner T remains below the toner amount detecting part 27 (at the bottom of the lower housing 33 of the developing unit 20) as illustrated in FIG. 5A after the toner amount detecting part 27 is caused by the agitating/conveying part 24 and the synchronizing part 26 to rotate upward and away from the toner supply roller 22. In this case, the toner amount detecting part 27 remains at an upper position (indicating that there is a sufficient amount of remaining toner T) as illustrated in FIG. 5A, and a print process is continued by the process unit 2.

Meanwhile, when the amount of remaining toner T becomes small or insufficient during a print process, only a small amount of toner T remains below the toner amount detecting part 27 after the toner amount detecting part 27 is caused by the agitating/conveying part 24 and the synchronizing part 26 to rotate upward and away from the toner supply roller 22 up to a position indicated by a dotted line in FIG. 5B. In this case, the toner amount detecting part 27 is caused by the torsion spring 266 (see FIG. 7) and its own weight to rotate toward the toner supply roller 22 to the lower position (indicating that the amount of remaining toner T is small or the toner replacement timing) indicated by a solid line in FIG. 5B.

When the toner amount detecting part 27 reaches the lower position illustrated in FIG. 5B, the sensor 30 (see FIG. 8)

provided in the image forming apparatus 1 detects the position of the arm 28 that rotates in synchronization with the toner amount detecting part 27 and reports to the user that the toner replacement timing has come or it is close to the toner replacement timing.

<Problems that Occur when Toner Flow Restricting Parts are not Provided>

Figure 9A:
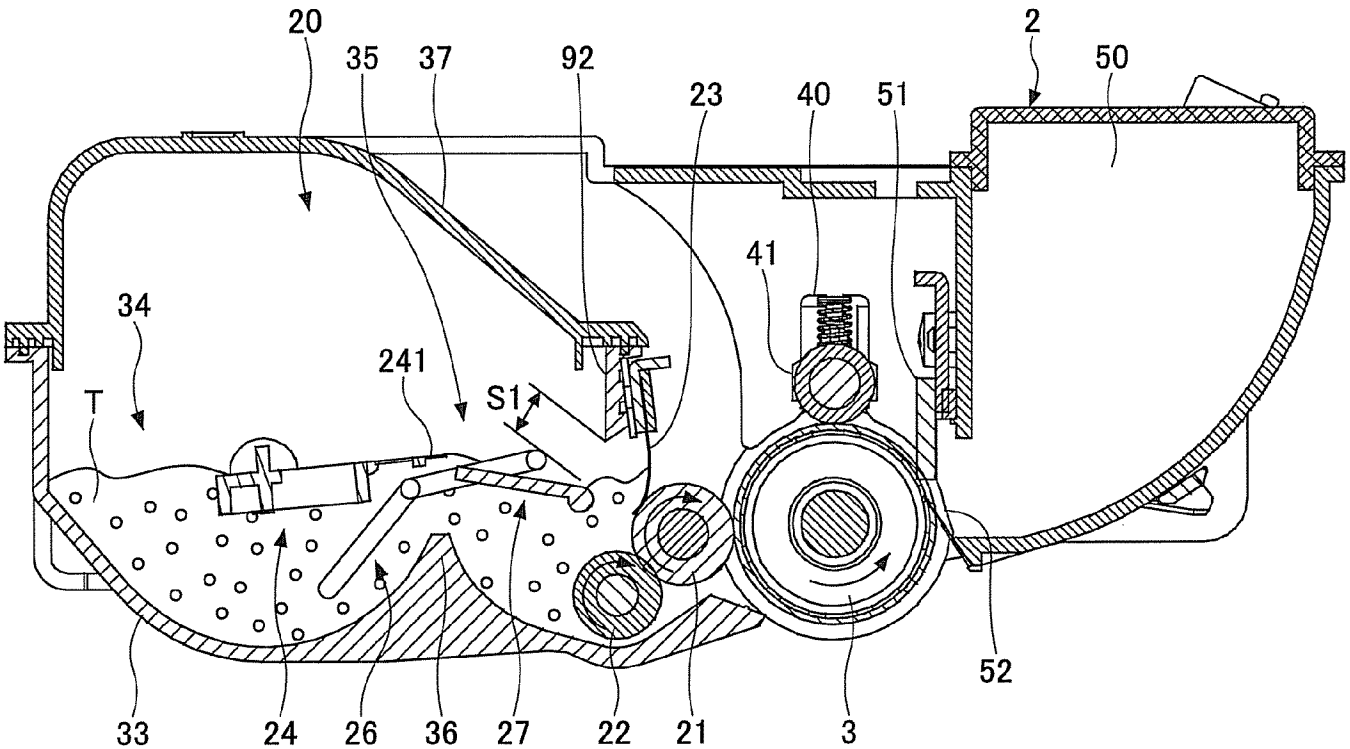
FIG. 9A is a drawing used to describe problems that may occur when no toner flow restricting part is provided.
Figure 9B:
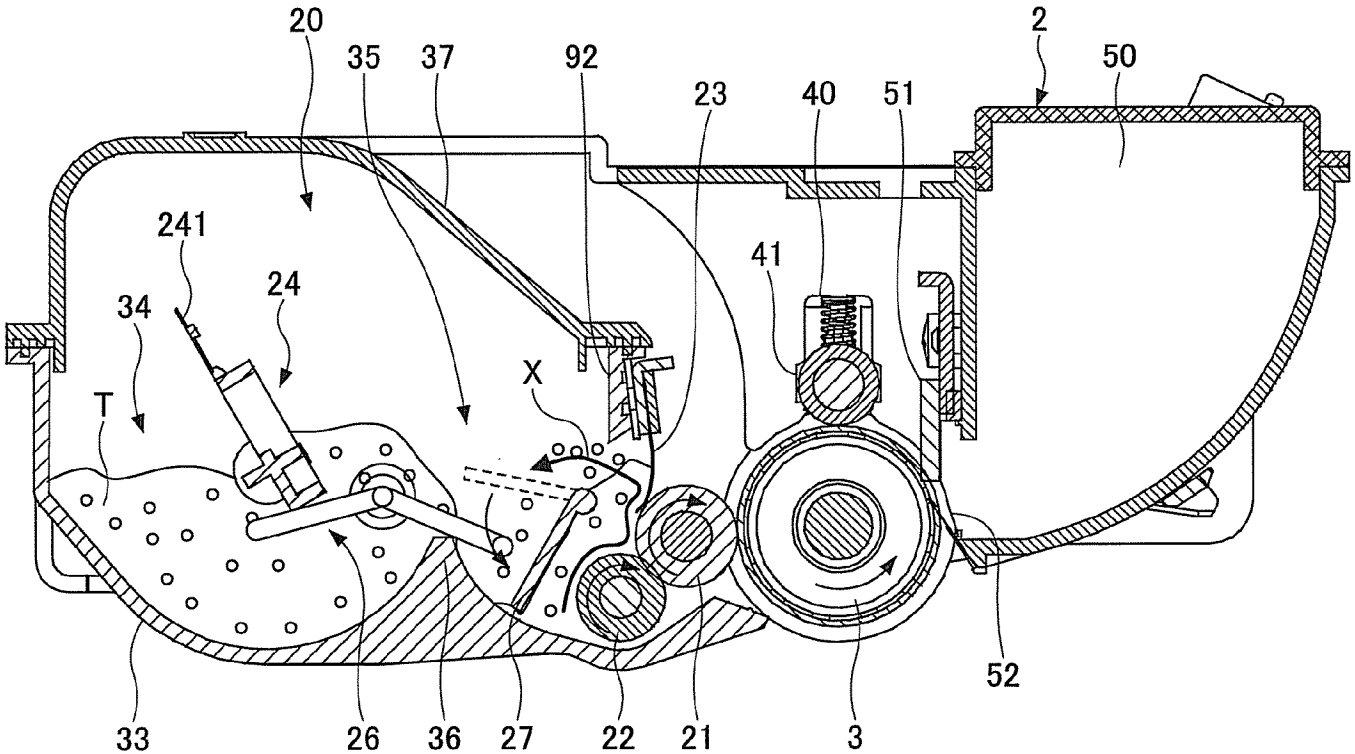
FIG. 9B is a drawing used to describe problems that may occur when no toner flow restricting part is provided.

FIGS. 9A and 9B are drawings used to describe problems that may occur when the toner flow restricting parts 90 are not provided.

As illustrated in FIG. 9A, when the surface level of remaining toner T is substantially the same as the height of the rotational shaft 271*a* of the toner amount detecting part 27, a gap S1 may be formed between the fixing part 92 of the lower housing 33 and the toner amount detecting part 27.

When a print process is started at the process unit 2, the toner supply roller 22 and the developing roller 21 are rotated by drive parts not shown (e.g., gears) in the directions indicated by arrows in FIG. 9B to convey the toner T to the photoconductor 3. Meanwhile, the toner T near the toner supply roller 22 and the developing roller 21 forms a toner flow as indicated by an arrow X in FIG. 9B. The toner flow proceeds clockwise from an area near the lower-left part of the toner supply roller 22 along the outer surface of the toner supply roller 22 to the nip between the toner supply roller 22 and the developing roller 21.

Next, the toner flow proceeds clockwise from an area near the lower-left part of the developing roller 21 along the outer surface of the developing roller 21 to an area above the developing roller 21. Then, the toner flow proceeds upward along a surface of the limiting part 23 that is in contact with the developing roller 21.

The toner T conveyed as described above to an area near the limiting part 23 is pushed by a succeeding flow of the toner T and further proceeds substantially counterclockwise through the gap S1 between the fixing part 92 of the lower housing 33 and the toner amount detecting part 27. Thus, the toner T below the toner amount detecting part 27 is conveyed through the gap S1 to an area above the toner amount detecting part 27. As a result, the toner amount detecting part 27 rotates further toward the toner supply roller 22, reaches the lower position, and the rotating part 29 is detected by the sensor 30. Thus, when the toner flow restricting parts 90 are not provided, the sensor 30 may falsely report the toner replacement timing to the user.

<Effects of Toner Flow Restricting Parts>

Figure 10A:
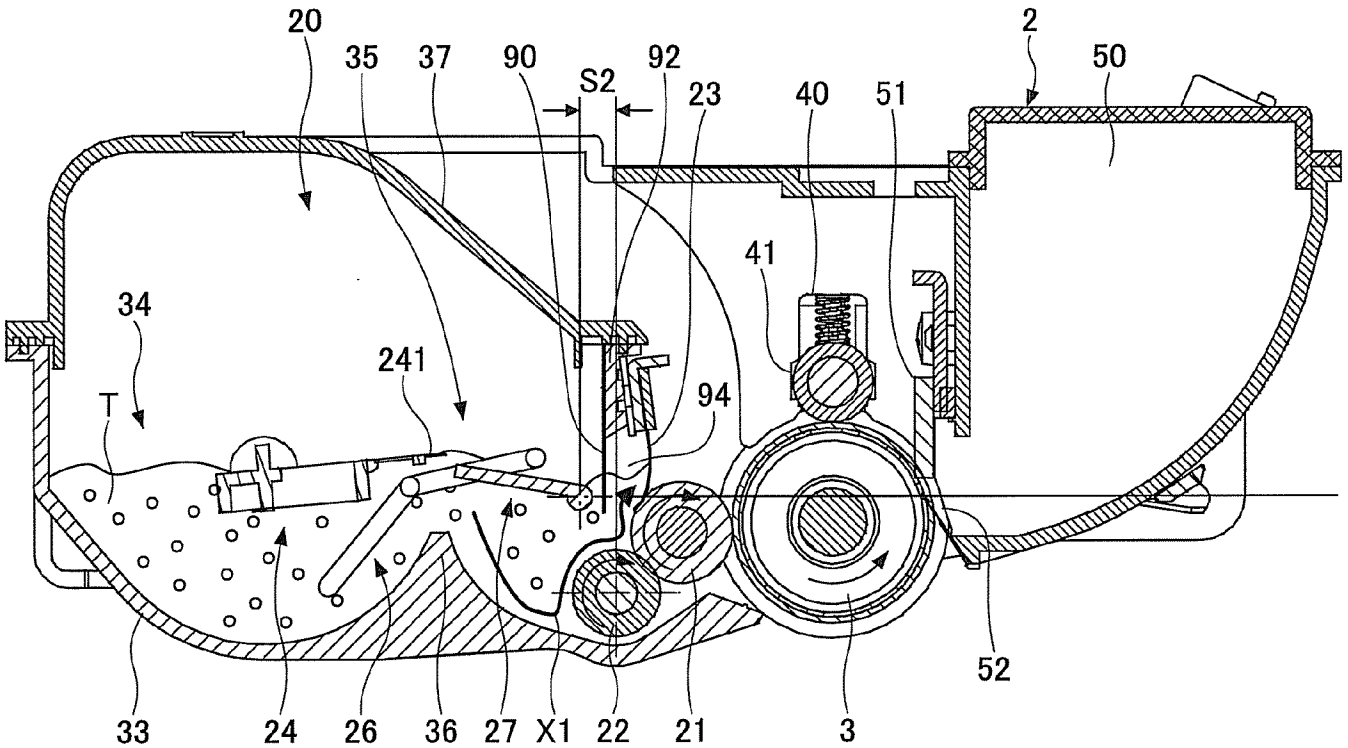
FIG. 10A is a drawing used to describe effects of toner flow restricting parts.
Figure 10B:
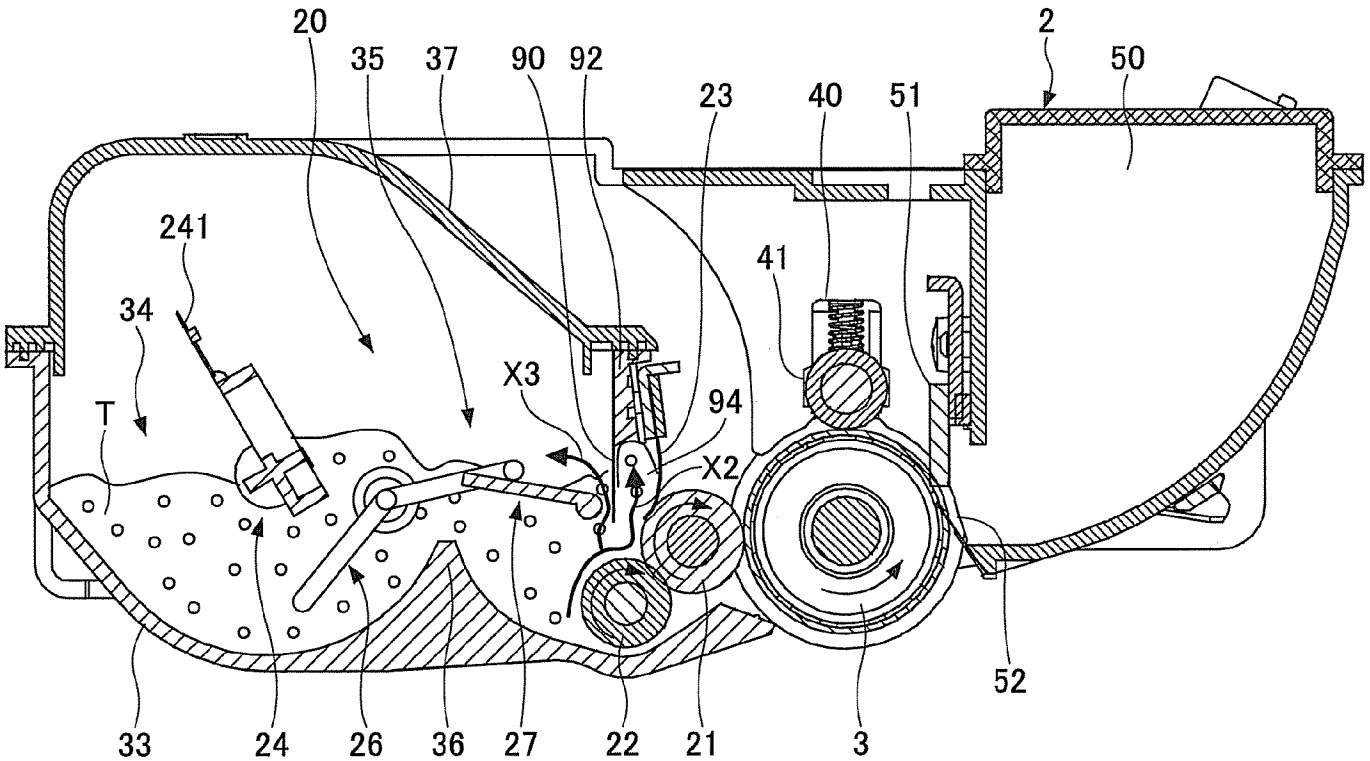
FIG. 10B is a drawing used to describe effects of toner flow restricting parts.

FIGS. 10A and 10B are drawings used to describe effects of the toner flow restricting parts 90.

As illustrated in FIG. 10A, the upper ends (with respect to the direction of gravitational force) of the toner flow restricting parts 90 are fixed to the fixing part 92 of the lower housing 33, and the lower ends of the toner flow restricting parts 90 are free ends. Also in FIG. 10A, the lower ends of the toner flow restricting parts 90 are positioned one the right side of the center of the rotational shaft 271*a* of the toner amount detecting part 27 and lower than the center of the rotational shaft 271*a* in the direction of gravitational force. Further in FIG. 10A, the toner flow restricting parts 90 are disposed in a space S2 formed between the rotational shaft 271*a* and the rotational shaft of the toner supply roller 22 in the horizontal direction. There is a very small gap between the rotational shaft 271*a* and the toner flow restricting parts 90.

When the surface level of remaining toner T is substantially the same as the height of the rotational shaft 271*a* of the toner amount detecting part 27, the gap S1 (see FIG. 9A) is formed between the fixing part 92 of the lower housing 33 and the toner amount detecting part 27. The toner flow restricting parts 90 extend downward in a substantially vertical direction (or in the direction of gravitational force) from the fixing part 92 of the lower housing 33 and block the gap S1.

When the agitating/conveying part 24 rotates and the toner T is supplied to the developing chamber 35, the toner T in the developing chamber 35 forms a toner flow X1 that proceeds clockwise from an area near the lower-left part of the toner supply roller 22 along the outer surface of the toner supply roller 22 to the nip between the toner supply roller 22 and the developing roller 21.

Next, the toner flow X1 is caused by the rotation of the developing roller 21 to proceed clockwise from an area near the lower-left part of the developing roller 21 along the outer surface of the developing roller 21 to an area above the developing roller 21. Then, the toner flow X1 proceeds upward along a surface of the limiting part 23 that is in contact with the developing roller 21. In the present embodiment, however, the toner flow restricting parts 90 blocking the gap S1 between the fixing part 92 of the lower housing 33 and the toner amount detecting part 27 prevent the toner T from flowing through the gap S1 into an area above the toner amount detecting part 27 (or to the upper side of the toner amount detecting part 27). Thus, the toner flow restricting parts 90 make it possible to prevent the toner amount detecting part 27 from rotating to the lower position when there is a sufficient amount of remaining toner T, and prevent the sensor 30 from falsely detecting the toner replacement timing. In other words, the present embodiment makes it possible to improve the accuracy in detecting the toner replacement timing.

Referring to FIG. 10B, when a print process is started at the process unit 2, the toner flow X1 generated by the rotation of the toner supply roller 22 and the developing roller 21 is divided by the toner flow restricting parts 90 into two toner flows X2 and X3.

In general, the fluidity of toner changes due to degradation caused by repeated use and depending on environments. For example, the fluidity of toner is reduced when the toner is degraded or kept in a high temperature and high humidity environment, and the toner becomes liable to agglomerate together (this agglomeration is referred to as "toner packing"). Here, the toner flow restricting parts 90 of the present embodiment are made of a flexible material and therefore absorb the force (or impact) of the toner flows X2 and X3 by the flexibility. This configuration makes it possible to prevent the toner packing of the toner T that is trapped in the square-bracket-shaped area 94.

Flow of the toner T in the square-bracket-shaped area 94 is described below. The toner flow X2 proceeding upward along the limiting part 23 is blocked by the toner flow restricting parts 90 and does not pass through the gap S1 (see FIG. 9A) between the fixing part 92 of the lower housing 33 and the toner amount detecting part 27.

Since the toner T is continuously supplied into the square-bracket-shaped area 94 by the upward toner flow X2 caused by the toner supply roller 22 and the developing roller 21, the square-bracket-shaped area 94 is filled with the toner T. If the toner T is further supplied into the square-bracket-shaped area 94, toner packing may occur.

With the configuration of the present embodiment, when the square-bracket-shaped area 94 is filled with the toner T, a part of the toner T caused to flow upward by the toner supply roller 22 forms the toner flow X3 that goes through the very small gap between the toner amount detecting part 27 and the toner flow restricting parts 90. This in turn prevents toner packing in the square-bracket-shaped area 94.

When the free ends (lower ends) of the toner flow restricting parts 90 are positioned higher than the center of the rotational shaft 271*a* of the toner amount detecting part 27 with respect to the direction of gravitational force, the effect of preventing a toner flow through the gap S1 may be reduced and the toner amount detecting part 27 may rotate to the lower position indicating the toner replacement timing. Therefore, it is preferable to extend the free ends (lower ends) of the toner flow restricting parts 90 to a position lower than the center of the rotational shaft 271*a* of the toner amount detecting part 27 with respect to the direction of gravitational force.

When the free ends (lower ends) of the toner flow restricting parts 90 are positioned on the right side of the rotational axis (or the center of the rotational shaft) of the toner supply roller 22, the toner T caused to move upward by the developing roller 21 flows through the gap (gap S1) between the toner amount detecting part 27 and the toner flow restricting parts 90 before the square-bracket-shaped area 94 is filled with the toner T. For this reason, it is preferable to position the free ends of the toner flow restricting parts 90 on the left side of the rotational axis of the toner supply roller 22.

When the toner flow restricting parts 90 are positioned on the left side of the rotational shaft 271*a* of the toner amount detecting part 27, the free ends of the toner flow restricting parts 90 need to be positioned higher than the rotational shaft 271*a* to prevent interference with the toner amount detecting part 27. As a result, the toner T flows through the gap (gap S1) between the toner amount detecting part 27 and the toner flow restricting parts 90 to an area above the toner amount detecting part 27. For this reason, it is preferable to position the toner flow restricting parts 90 between the rotational shaft 271*a* of the toner amount detecting part 27 and the rotational axis of the toner supply roller 22 in the horizontal direction, and to position the free ends of the toner flow restricting parts 90 lower than the rotational shaft 271*a*.

<First Variation>

Figure 11:
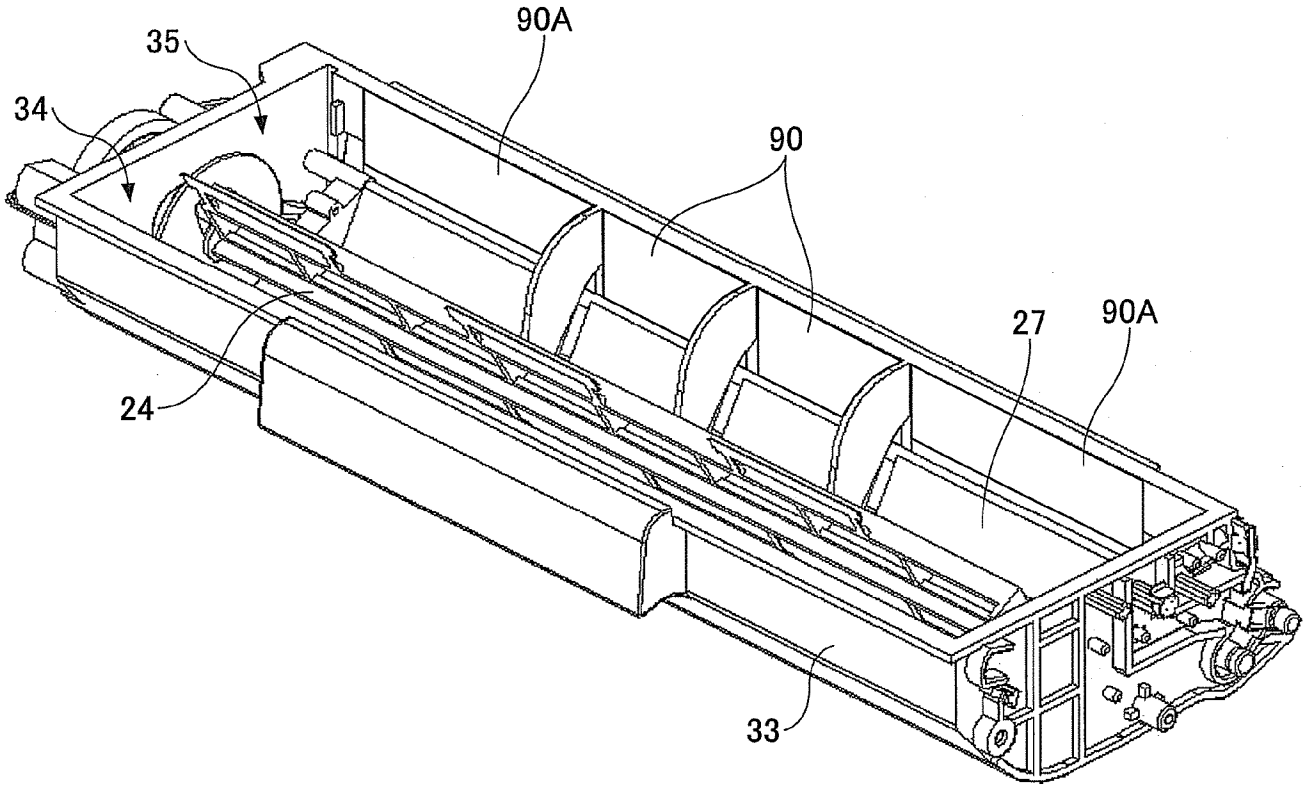
FIG. 11 is a drawing illustrating toner flow restricting parts according to a first variation.

FIG. 11 is a drawing illustrating toner flow restricting parts according to a first variation. In the first variation, as illustrated in FIG. 11, toner flow restricting parts with different lengths are arranged in the axial direction. In other words, in the first variation, the positions in the direction of gravitational force of the free ends (lower ends) of toner flow restricting parts vary depending on their positions in the axial direction.

In the example of FIG. 11, toner flow restricting parts 90 are placed in a center area in the axial direction of the developing unit 20 and toner flow restricting parts 90A are placed in end areas in the axial direction of the developing unit 20. The position of the free ends (lower ends) of the toner flow restricting parts 90A are higher than the position of the free ends (lower ends) of the toner flow restricting parts 90. In other words, the toner flow restricting parts 90A are shorter than the toner flow restricting parts 90 in the vertical direction (or the direction of gravitational force). Accordingly, the gap between the lower ends of the toner flow restricting parts 90A and the toner amount detecting part 27 are longer than the gap between the lower ends of the toner flow restricting parts 90 and the toner amount detecting part 27.

Thus, the position of the free ends of the toner flow restricting parts (90, 90A) in the end areas of the developing unit 20 is higher than that in the center area of the developing unit 20, and the gap between the toner flow restricting parts and the toner amount detecting part 27 in the end areas of the developing unit 20 is longer than that in the center area of the developing unit 20. With this configuration, the toner T in the end areas in the axial direction of the developing unit 20 flows more easily toward the container chamber 34 than the toner T in the center area of the developing unit 20. In general, the amount of toner used in printing is greater in the center area of the developing unit 20 than in the end areas of the developing unit 20. Also, when a single-component developer is degraded over repeated use, it may cause a printing problem such as scumming.

For the above reasons, it is preferable that the toner T in the developing chamber 35 is uniformly degraded. Here, since a larger amount of toner is consumed in printing in the center area of the developing unit 20, the amount of toner staying in the center area of the developing unit 20 is smaller than the amount of toner staying in the end areas of the developing unit 20

With the configuration of the first variation where the position of the free ends of the toner flow restricting parts in the end areas of the developing unit is higher than that in the center area, a larger amount of toner flows toward the container chamber 34 in the end areas than in the center area. This in turn makes it possible to make uniform the distribution in the axial direction of degraded toner in the developing chamber 35.

<Second Variation>

Figure 12:
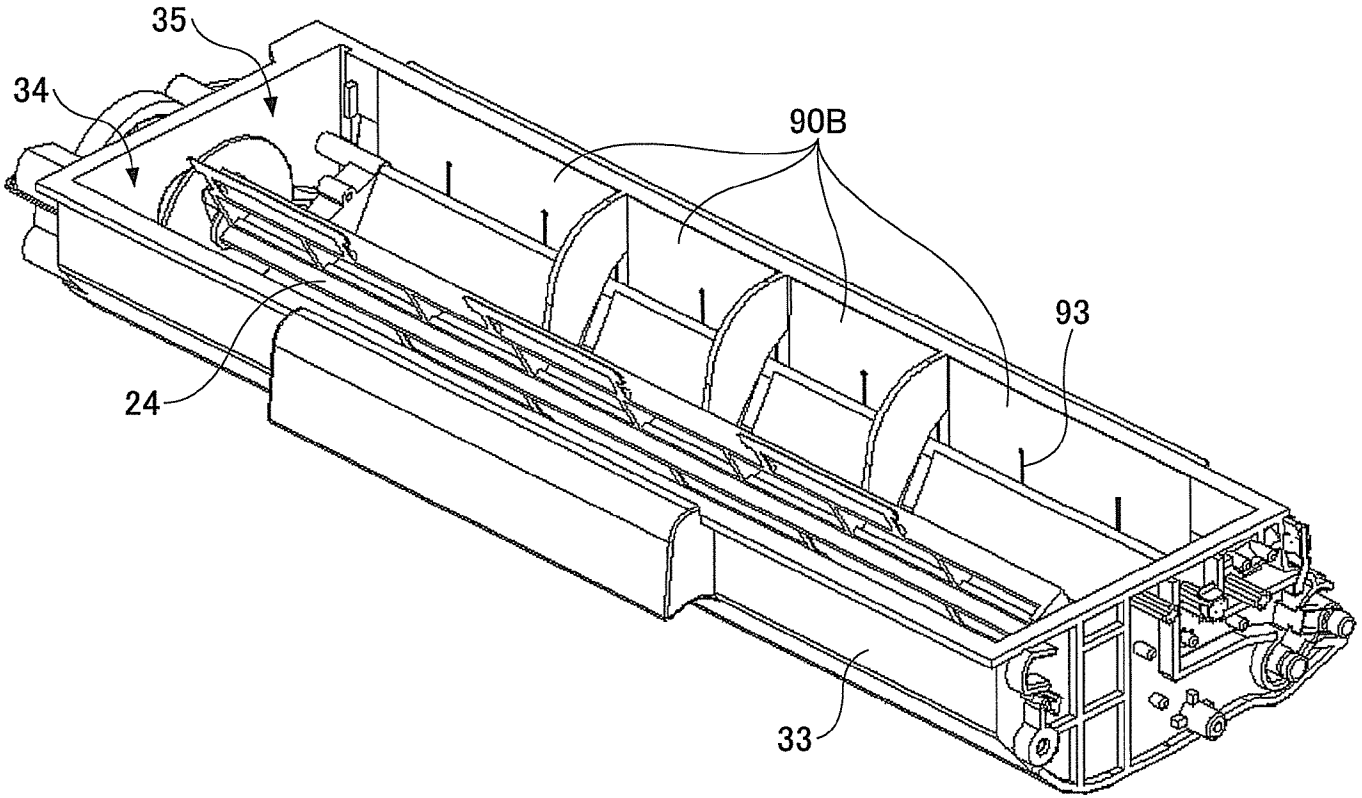
FIG. 12 is a drawing illustrating toner flow restricting parts according to a second variation.

FIG. 12 is a drawing illustrating toner flow restricting parts according to a second variation. In the second variation, as illustrated in FIG. 12, slits 93 extending in the vertical direction are formed in the free ends (lower ends) of toner flow restricting parts 90B.

The slits 93 are formed at predetermined intervals in the free ends (lower ends) of the toner flow restricting parts 90B. With the slits 93, the toner flow restricting parts 90B can more effectively absorb the pressure of a toner flow. That is, the slits 93 make the toner flow restricting parts 90B more flexible. The toner flow restricting parts 90B are bent by the pressure of the toner flow X3 in a direction away from the toner amount detecting part 27 and as a result, the toner flow X3 can proceed more easily toward the container chamber 34. This configuration makes it possible to more effectively prevent toner packing in the square-bracket-shaped area 94.

<Third Variation>

Figure 13:
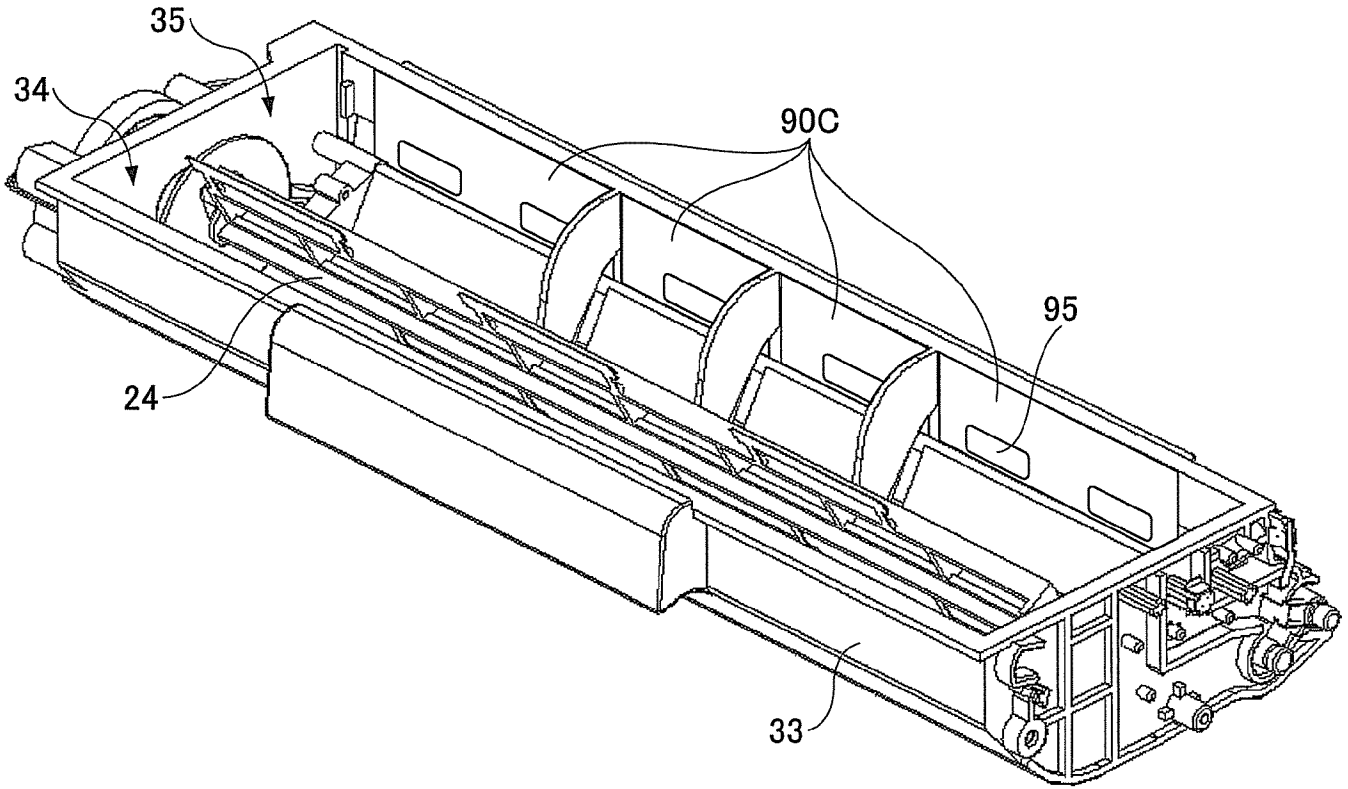
FIG. 13 is a drawing illustrating toner flow restricting parts according to a third variation.

FIG. 13 is a drawing illustrating toner flow restricting parts according to a third variation. In the third variation, as illustrated in FIG. 13, rectangular through holes (openings) 95 are formed near the free ends (lower ends) of toner flow restricting parts 90C.

This configuration allows the toner flow X3 to pass through the through holes 95 toward the container chamber 34 and thereby makes it possible to prevent toner packing in the square-bracket-shaped area 94 even when the amount of the toner T allowed to flow toward the container chamber 34 by deformation of the toner flow restricting parts 90C is not sufficient.

Also in the third variation, the opening area of the through holes 95 of the toner flow restricting parts 90C in the end areas in the axial direction of the developing unit 20 may be made greater than that in the center area in the axial direction of the developing unit 20. This configuration makes it possible to allow a larger amount of toner to flow toward the container chamber 34 in the end areas than in the center area.

The sizes, shapes (e.g., circular shape or triangular shape), and vertical and horizontal positions of the through holes 95 may be varied depending on the positions of the toner flow restricting parts 90C in the axial direction. Also, the through holes 95 may be combined with the toner flow restricting parts 90A of the first variation and/or the slits 93 of the second variation.

Thus, it is possible to fine-tune the degree of blocking the toner flow (or the degree of allowing the toner flow X3) by the toner flow restricting parts 90C by adjusting the opening area of the through holes 95 and by combining the through holes 95 with the toner flow restricting parts 90A and/or the slits 93. This in turn makes it possible to effectively prevent the toner packing of the toner T that is trapped in the square-bracket-shaped area 94 and to accurately report the toner replacement timing.

<Fourth Variation>

Figure 14:
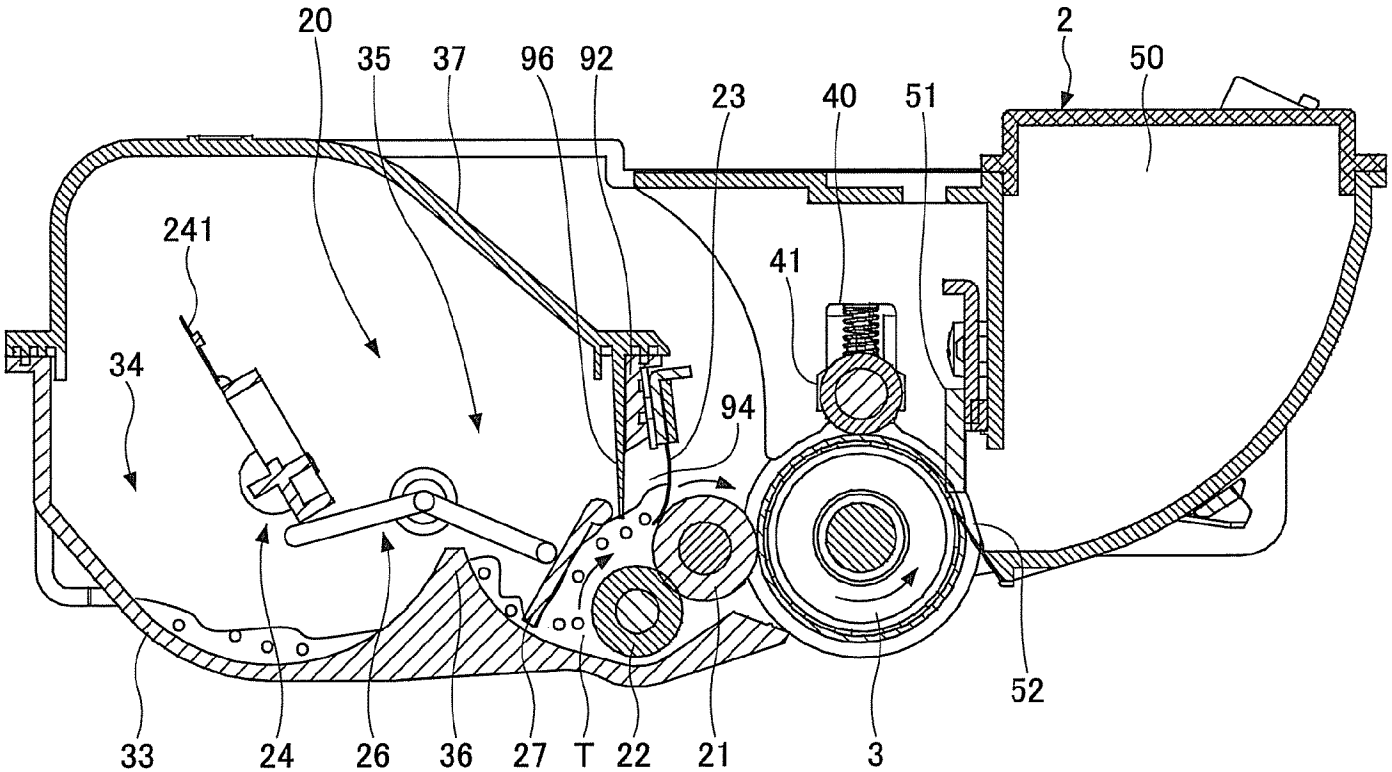
FIG. 14 is a drawing illustrating toner flow restricting parts according to a fourth variation.

FIG. 14 is a drawing illustrating toner flow restricting parts 96 according to a fourth variation. In the fourth variation, as illustrated in FIG. 14, the toner flow restricting parts 96 are formed as monolithic (or integral) parts of the upper housing 37 (by, for example, integral/monolithic molding). The toner flow restricting parts 96 are made of the same resin material as the upper housing 37 and like the toner flow restricting parts 90, are flexibly deformable by the pressure of a toner flow.

Forming the toner flow restricting parts 96 as monolithic (or integral) parts of the upper housing 37 makes it possible to reduce the number of components, eliminate the need to fix the toner flow restricting parts 96 to the fixing part 92 of the lower-housing 33, and thereby reduce the time and workload in assembling the developing unit 20.

In the above embodiment, it is assumed that the image forming apparatus 1 is a monochrome image forming apparatus. However, the above embodiment and the variations may also be applied to a color image forming apparatus including plural developing units or process units.

An aspect of this disclosure provides a developing device, a process unit, and an image forming apparatus that can accurately detect the amount of remaining toner and thereby accurately report toner replacement timing.

An aspect of this disclosure makes it possible to restrict the flow of toner, which is caused by the rotation of a toner supply part and a toner carrier, from an area below a toner amount detecting mechanism to an area above the toner amount detecting mechanism. This in turn makes it possible to accurately detect the amount of remaining toner and to accurately detect toner replacement timing.

An aspect of this disclosure provides a developing device that includes a developing chamber; a toner carrier disposed in the developing chamber; a toner supply part configured to supply toner to the toner carrier; a toner amount detecting part configured to change its rotational position according to an amount of the toner near the toner supply part to detect the amount of toner remaining in the developing chamber; and a toner flow restricting part configured to block at least a portion of the toner caused to flow backward to an upper side of the toner amount detecting part by a flow of the toner in the developing chamber which is generated by the rotation of the toner supply part and the toner carrier.

The toner amount detecting part is configured to rotate about a rotational shaft provided at the upper end of the toner amount detecting part, the rotational shaft of the toner amount detecting part is positioned above the toner supply part, and the toner flow restricting part is supported by a part of a housing located above the rotational shaft of the toner amount detecting part and extends toward the rotational shaft of the toner amount detecting part. A gap is formed between the part of the housing and the rotational shaft of the toner amount detecting part.

The toner flow restricting part may be disposed between the center of a rotational shaft of the toner supply part and the center of the rotational shaft of the toner amount detecting part.

A developing device, a process unit, and an image forming apparatus are described above as preferred embodiments. However, the present invention is not limited to the specifically disclosed embodiments, and variations and modifications may be made without departing from the scope of the present invention.

What is claimed is:

1. A developing device, comprising:

a developing chamber;

a toner carrier disposed in the developing chamber;

a toner supply part to supply toner to the toner carrier;

a toner amount detecting part to change a rotational position thereof according to an amount of the toner near the toner supply part to detect an amount of the toner remaining in the developing chamber;

a toner flow restricting part to block movement of the toner around the toner amount detecting part which is caused by a flow of the toner in the developing chamber generated by rotation of the toner supply part and the toner carrier; and a limiting part to limit a thickness of a toner layer on a surface of the toner carrier, wherein the toner flow restricting part is disposed in a space between the limiting part and the toner amount detecting part and blocks a flow of the toner through a gap between a housing forming the developing chamber and the toner amount detecting part.

2. The developing device as claimed in claim 1, wherein the toner flow restricting part is shaped like a thin plate one end of which is supported by the housing forming the developing chamber.

3. The developing device as claimed in claim 2, wherein an upper end of the toner flow restricting part is fixed to the housing and a lower end of the toner flow restricting part extends downward in a substantially vertical direction as a free end.

4. The developing device as claimed in claim 3, wherein the toner flow restricting part comprises a plurality of toner flow restricting parts that are arranged in a length direction of the toner carrier and the toner supply part substantially parallel to a rotational shaft of the toner amount detecting part; and the free ends of some or all of the toner flow restricting parts are positioned lower than a center of the rotational shaft of the toner amount detecting part with respect to a direction of gravitational force.

5. The developing device as claimed in claim 3, wherein the toner flow restricting part is disposed between a rotational shaft of the toner amount detecting part and a rotational shaft of the toner supply part in a horizontal direction.

6. The developing device as claimed in claim 1, wherein the toner flow restricting part comprises a flexible sheet material.

7. The developing device as claimed in claim 6, wherein one or more slits extending in a direction of gravitational force are formed in the toner flow restricting part.

8. The developing device as claimed in claim 6, wherein one or more through holes that allow the toner to flow therethrough are formed in the toner flow restricting part.

9. The developing device as claimed in claim 1, wherein the toner flow restricting part comprises polyethylene terephthalate or polybutylene terephthalate.

10. The developing device as claimed in claim 1, wherein the toner flow restricting part comprises stainless steel or phosphor bronze.

11. A process unit comprising the developing device of claim 1.

12. An image forming apparatus comprising the process unit of claim 11.

13. A developing device, comprising:

a developing chamber;

a toner carrier disposed in the developing chamber;

a toner supply part to supply toner to the toner carrier;

a toner amount detecting part to change a rotational position thereof according to an amount of the toner near the toner supply part to detect an amount of the toner remaining in the developing chamber;

a toner flow restricting part to block movement of the toner around the toner amount detecting part which is caused by a flow of the toner in the developing chamber generated by rotation of the toner supply part and the toner carrier; and a housing that forms the developing chamber and includes an upper housing and a lower housing, wherein the toner flow restricting part is formed as an integral part of the upper housing.

14. A process unit comprising the developing device of claim 13.

15. An image forming apparatus comprising the process unit of claim 14.

16. A developing device, comprising:

a developing chamber;

a toner carrier disposed in the developing chamber;

a toner supply part to supply toner to the toner carrier;

a toner amount detecting part to change a rotational position thereof according to an amount of the toner near the toner supply part to detect an amount of the toner remaining in the developing chamber; and a toner flow restricting part to block at least a portion of the toner caused to flow backward to an upper side of the toner amount detecting part by a flow of the toner in the developing chamber which is generated by rotation of the toner supply part and the toner carrier, wherein the toner amount detecting part rotates about a rotational shaft provided at an upper end thereof;

the rotational shaft of the toner amount detecting part is positioned above the toner supply part; and the toner flow restricting part is supported by a part of a housing located above the rotational shaft of the toner amount detecting part and extends toward the rotational shaft of the toner amount detecting part, the part of the housing and the rotational shaft of the toner amount detecting part forming a gap therebetween.

17. The developing device as claimed in claim 16, wherein the toner flow restricting part is disposed between a center of a rotational shaft of the toner supply part and a center of the rotational shaft of the toner amount detecting part.

18. A process unit comprising the developing device of claim 16.

19. An image forming apparatus comprising the process unit of claim 18.

* * * * *